US005710702A

United States Patent [19]

Hayashi et al.

[11] Patent Number: 5,710,702

[45] Date of Patent: Jan. 20, 1998

[54] APPARATUS FOR TRANSMITTING INFORMATION FOR VEHICLE

[75] Inventors: Hironao Hayashi, Gifu-ken; Ken Goto, Nagoya, both of Japan

[73] Assignee: Toyota Jidosha Kabushiki Kaisha, Toyota, Japan

[21] Appl. No.: 467,998

[22] Filed: Jun. 6, 1995

[30] Foreign Application Priority Data

Jun. 16, 1994 [JP] Japan ..... 6-134608

[51] Int. Cl.[6] ..... G07B 15/00

[52] U.S. Cl. ..... 364/423.098; 340/928; 235/384

[58] Field of Search ..... 364/423.098, 464.01, 364/401; 340/928; 235/380, 382, 384

[56] References Cited

U.S. PATENT DOCUMENTS

| | | | |
|---|---|---|---|
| 4,303,904 | 12/1981 | Chasek | 235/384 |
| 5,086,389 | 2/1992 | Hassett et al. | 340/928 |
| 5,101,200 | 3/1992 | Sweet | 340/928 |
| 5,144,553 | 9/1992 | Hassett et al. | 235/384 |
| 5,289,183 | 2/1994 | Hassett et al. | 340/928 |
| 5,428,353 | 6/1995 | Bird | 340/928 |
| 5,451,758 | 9/1995 | Jesadanont | 340/928 |
| 5,485,520 | 1/1996 | Chaum et al. | 235/384 |
| 5,554,984 | 9/1996 | Shigenaga et al. | 340/928 |

FOREIGN PATENT DOCUMENTS

| | | |
|---|---|---|
| 4233067 | 8/1992 | Japan . |
| 4255090 | 9/1992 | Japan . |
| 5 35933 | 2/1993 | Japan . |
| 5210771 | 8/1993 | Japan . |
| 5274507 | 10/1993 | Japan . |

OTHER PUBLICATIONS

Ishikawa, et al: "Development of Vehicle–mounted ID Tag and its Use in Road Traffic Systems".

*Primary Examiner*—Gary Chin

*Attorney, Agent, or Firm*—Cushman, Darby & Cushman, IP Group of Pillsbury Madison & Sutro LLP

[57] ABSTRACT

An apparatus for transmitting information for a vehicle notifies a user of a range which can be reached by a vehicle with the present balance in a card. A vehicle-mounted device transmits a response signal upon receiving an inquiry signal from a road device. If it is determined on the basis of the signal from the road device that the vehicle is passing through an entrance gate, an exit gate which can be reached with the present balance is calculated on the basis of vehicle type information stored, balance information, and a toll table. As the name of the calculated exit gate is displayed on a display unit, a reachable range is notified to the vehicle.

21 Claims, 27 Drawing Sheets

VEHICLE-MOUNTED DEVICE FIG.7

VEHICLE-MOUNTED DEVICE

START
420
IS INQUIRY SIGNAL RECEIVED?
N
Y
IS RESPONSE SIGNAL TRANSMITTED?
422
424
IS SIGNAL RECEIVED?
N
Y
426
ENTRANCE GATE?
N
Y
428
TRANSMIT VEHICLE TYPE AND BALANCE
450
OTHER PROCESSING
452
IS EXIT GATE NAME RECEIVED?
N
Y
NOTIFY EXIT GATE NAME
454
END

ENTRANCE GATE

IS THERE NO DISTINCTION BETWEEN UP ROAD AND DOWN ROAD?
N
462
LIMIT COURSE TO ONE DIRECTION
460
Y
464
IS THERE BRANCHING POINT?
N
466
Y
CALCULATE EXIT GATE CORRESPONDING TO EACH ROUTE
468
CALCULATE EXIT GATE
DISPLAY ALL THE EXIT GATES
470
472
IS EXIT GATE SELECTED?
N
Y
DISPLAY ONLY NECESSARY EXIT GATE
474
END

CASH REGISTER FIG. 15

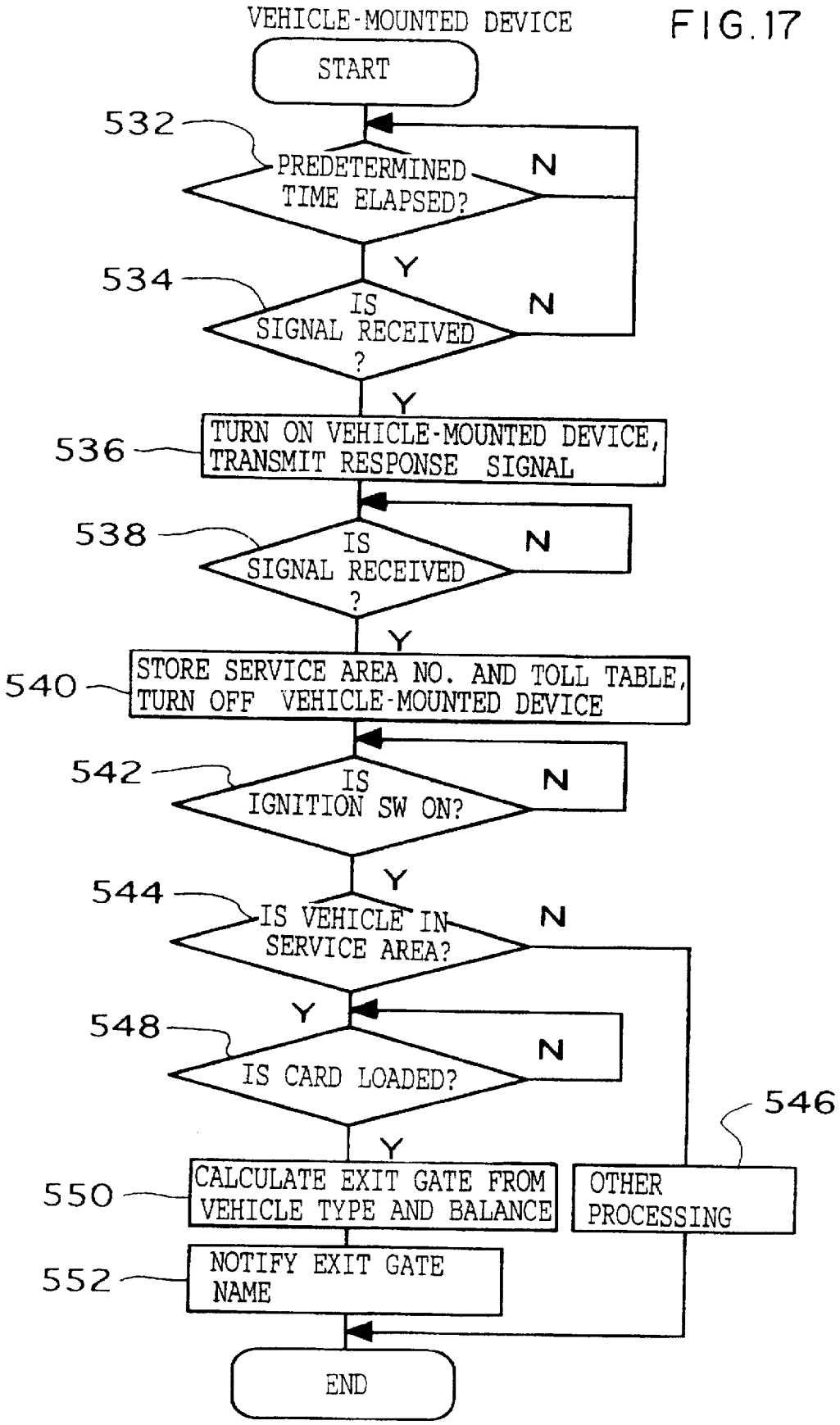
VEHICLE-MOUNTED DEVICE
FIG.17
START
532
PREDETERMINED TIME ELAPSED?
N
Y
534
IS SIGNAL RECEIVED ?
N
Y
536
TURN ON VEHICLE-MOUNTED DEVICE, TRANSMIT RESPONSE SIGNAL
538
IS SIGNAL RECEIVED ?
N
Y
540
STORE SERVICE AREA NO. AND TOLL TABLE, TURN OFF VEHICLE-MOUNTED DEVICE
542
IS IGNITION SW ON?
N
Y
544
IS VEHICLE IN SERVICE AREA?
N
Y
548
IS CARD LOADED?
N
Y
546
OTHER PROCESSING
550
CALCULATE EXIT GATE FROM VEHICLE TYPE AND BALANCE
552
NOTIFY EXIT GATE NAME
END

VEHICLE-MOUNTED DEVICE

VEHICLE-MOUNTED DEVICE FIG.23

APPARATUS FOR TRANSMITTING INFORMATION FOR VEHICLE

BACKGROUND OF THE INVENTION

1. Field of the Invention

The present invention relates to an apparatus for transmitting information for a vehicle, and more particularly to an apparatus for transmitting information for a vehicle whereby a vehicle driver is notified of the range which can be reached on a toll road, such as an expressway, on the driver's current prepaid account balance.

2. Description of the Related Art

In recent years, automatic toll receiving apparatuses making use of prepaid-type cards have been developed for receipt of fees at fee-receiving facilities, e.g., the receipt at toll booths and the like of toils which must be paid for use of toll roads. In such a prepaid system, a prepayment is recorded in advance in the card. Each time a toll road is used, a toll is subtracted from the amount recorded in the card at an exit toll station gate by means of radio communication, and the balance is recorded in the card.

With such an automatic toll receiving apparatus, however, in cases where the balance recorded in the card is less than the amount of the toll, receipt of the toll by means of the card becomes difficult, and troublesome efforts, such as the payment in cash of the amount by which the card is short, are required.

To solve this drawback, a technique is disclosed in Japanese Patent Application Laid-Open No. 5-274507 wherein a comparison is made between the balance recorded in the card and a preset limit, and if the balance is less than the limit, the user is notified to that effect.

Incidentally, techniques relating to the present invention include those disclosed in Japanese Patent Application Laid-Open Nos. 5-210771, 4-233067, 4-255090, 5-274507, and 5-35933.

However, since the toll of a toll road becomes gradually higher with an increase in the traveled distance, even though the balance may appear to be sufficiently large at an entrance gate of the toll road, the balance may become short midway in the course of travel if the distance to an exit gate is long.

In addition, in a system in which a payment for services in a service area can be made by the card, even if the distance to the exit gate is short, the balance may become short at the exit gate depending on how the card was used in the service area.

Accordingly, since the above-described conventional automatic toll receiving apparatus, which notifies the driver when the balance is less than a limit, is not adapted to cope with balances which change frequently, it is impossible to notify the driver of valid information. Hence, there is a drawback in that the balance may become short at an exit gate of a fee-charging area such as a toll road, so that troublesome efforts, such as paying the remainder of the toll in cash after stopping the vehicle, are required.

SUMMARY OF THE INVENTION

The present invention has been devised to overcome the above-described drawbacks, and its primary object is to provide an apparatus for transmitting information for a vehicle which does not require troublesome operation at the exit gate of a fee-charging area, by notifying the user of a range which can be reached with the present balance in the card.

A second object of the present invention is to provide an apparatus for transmitting information for a vehicle which does not require troublesome operation at the exit gate of a fee-charging area, by notifying the user of a fee corresponding to the traffic conditions.

To attain the above-described primary object, in accordance with a first aspect of the present invention, there is provided an apparatus for transmitting information for a vehicle, comprising: a notifying device for notifying the vehicle of a reachable range which can be reached by the vehicle and which is calculated on the basis of predetermined toll information and balance information expressing a remaining amount of an amount of prepaid for toll.

In addition, in accordance with a second aspect of the present invention, there is provided a system for transmitting information for a vehicle, comprising: traffic-condition detecting means for detecting traffic conditions; and notifying means for notifying the vehicle of a toll calculated on the basis of results of detection by the traffic-condition detecting means.

The apparatus for transmitting information for a vehicle in accordance with the first aspect of the present invention comprises the notifying device for notifying the vehicle of a reachable range which can be reached by the vehicle and which is calculated on the basis of predetermined toll information and balance information expressing a remaining amount of an amount prepaid for toll. As the notifying device, it is possible to use an audibly notifying device such as a speaker for notifying by speech or a visually notifying device which is a display means such as an LED or a CRT for notifying by displaying characters, an icon, or the like.

In accordance with the first aspect of the present invention, since the range which can be reached with the present balance information is notified, it is possible to impart to the driver effective information for coping with a balance which changes frequently.

Exit information may be used as the reachable range to be notified. By notifying the vehicle of the exit information in this manner, it is possible to confirm a reachable exit. Incidentally, if there is no reachable exit, the driver may be notified to that effect, or the reachable range may not be notified.

If a branching point is present in the course of travel, exit information corresponding to each route branching off from the branching point may be used as the reachable range. By adopting this arrangement, in a case where the traveling route branches ahead, it is possible to confirm a reachable exit whichever route is selected. In this case, if a selecting means is further provided for selecting at least one item of information from items of exit information corresponding to the respective routes, only the information on a relevant exit among a plurality of reachable exits is notified, so that it is possible to prevent confusion. In particular, when the information is displayed on a visually notifying device, only the necessary exit information can be selectively displayed, so that it is easier to view the relevant information.

In addition, if notification of the exit information concerning a route other than the route being traveled is stopped when the vehicle has passed the branching point, unnecessary information is not notified when the branching point has been passed. Hence, it is possible to reliably and speedily ascertain a reachable exit.

In addition, distance information may be used as the reachable range to be notified. As the reachable distance is thus notified, it is possible to accelerate the recognition of a reachable point. In addition, the distance information may be distance information in which a point of departure such as an entrance gate may be set as a reference, or may be distance information in which a present point of time or a present traveling section is set as a reference. Further, both distance information and exit information may be notified, or may be selectively notified.

In the above-described first aspect of the present invention, it is effective if a detecting means is further provided for detecting the entry of the vehicle into an area where a balance increasing device for increasing the balance information is installed, the vehicle is notified by the notifying device of the entry of the vehicle into the area where the balance increasing device is installed. If the driver is thus notified of the fact that the balance can be increased, the driver is prevented from forgetting to increase the balance.

In addition, if the calculation of the reachable range is completed when the vehicle is stopped in the area where the balance increasing device is installed, the driver is able to quickly confirm the reachable range when resuming driving.

Further, if an arrangement is provided such that a timing at which the balance information is increased is further calculated on the basis of information on the position of the balance increasing device for increasing the balance information, and the notifying device notifies the vehicle of the timing, since the increasing of the balance is prompted, it is possible to prevent a shortage of the balance at the exit.

As the traffic conditions detected by the traffic-condition detecting means in accordance with the second aspect of the present invention, it is possible to use either an average vehicle speed or an elapsed time. If the average vehicle speed is not more than a predetermined value, the toll may be calculated at a rate lower than that for a case where the average vehicle speed exceeds the predetermined value. Also, if the elapsed time exceeds a predetermined value, the toll may be calculated at a rate lower than that for a case where the elapsed time is not more than the predetermined value. Consequently, it is possible to notify the driver of a toll corresponding to the past traveling history of the vehicle.

In addition, the balance in which a toll for the section or sections traveled up to now is subtracted from the present balance may be calculated as a toll corresponding to the route which has been traveled. Consequently, it is possible to confirm the range which can be reached with the balance.

The apparatus for transmitting information for a vehicle in accordance with the above-described aspects of the present invention may be applied to an automatic toll receiving system for receiving a toll through communication between a road device which is installed on a road and a vehicle-mounted device which is mounted in the vehicle and in which a card with balance information recorded therein can be loaded. In this case, it suffices if collating means for collating with the balance information of the card and notifying means for notifying the vehicle of a calculated reachable range are mounted in the vehicle-mounted device, and calculating means is mounted in one of the road device and the vehicle-mounted device for calculating the reachable range which can be reached by the vehicle with present balance on the basis of the balance information collating with by the collating means and predetermined toll information, and the vehicle is notified of the reachable range by the notifying means.

In this case, the receipt of the toll is effected by communication between the road device installed on the road and the vehicle-mounted device mounted in the vehicle. A card with the balance information recorded therein can be loaded in the vehicle-mounted device. As the card, it is possible to use a prepaid-type card such as an IC card, an LSI card, a magnetic card, a hologram card, or the like in which a prepaid amount is recorded as balance information. The reachable range is calculated on the basis of the balance information and preset toll information.

In a case where the calculating means is provided in the road device, information on the balance of the card collated with by the collating means and the vehicle type are transmitted from the vehicle-mounted device to the road device, and the range which can be reached with the present balance is calculated by the calculating means on the basis of the balance information, the vehicle type information, and the preset toll information. Then, information on the calculated reachable range is transmitted to the vehicle-mounted device, and is notified by the notifying device provided in the vehicle-mounted device. Although the vehicle type information may be transmitted from the vehicle-mounted device to the road device as described above, the vehicle type may be detected by image processing which is based on an image obtained by photographing the vehicle body or an image obtained by photographing the license plate, and may be transmitted from a vehicle-type detecting means installed on the road to the road device by radio communication or communication by wire.

Generally, since the road device is installed on the road, it is possible to use a large-size information processing device as the road device, and a compact information processing device is used as the vehicle-mounted device since the vehicle-mounted device is mounted in the vehicle. Hence, if the calculating means is provided in the road device, the reachable range can be calculated by the large-size information processing device, so that the reachable range can be calculated at high speed.

In addition, in a case where the calculating means is provided in the vehicle-mounted device, information on the balance in the card is collated with by the collating means, the reachable range is calculated by the calculating means on the basis of the present balance information of the card collated with, and the preset toll information, and the vehicle is notified of the reachable range by the notifying device. The toll information such as a toll table used for calculating the reachable range may be stored in the vehicle-mounted device, but since a compact information processing device is generally used as the vehicle-mounted device, if the aforementioned toll information is stored in advance in the road device, and this toll information is transmitted from the road device to the vehicle-mounted device at the time of calculation of the reachable range, the storage capacity of the storage circuit (memory) of the vehicle-mounted device can be reduced since it is not necessary to store the toll information in the vehicle-mounted device at all times. In addition, since the number of road devices is overwhelmingly smaller than the number of the vehicle-mounted devices, the revision of toll information at a time of toll revision is facilitated.

As described above, the notifying device may be an audibly notifying device such as a speaker for notifying by speech or a visually notifying device which is a display means such as an LED or a CRT for notifying by displaying characters, an icon, or the like.

The notification of the reachable range may be carried out when the vehicle approaches an entrance gate of a toll road or has entered a service area.

In a case where the apparatus for transmitting information for a vehicle is applied to an automatic toll receiving apparatus for receiving a toll through communication between a road device which is installed on a road and a vehicle-mounted device which is mounted in the vehicle and in which a card with balance information recorded therein can be loaded, it suffices if calculating means is mounted in the vehicle-mounted device for calculating the toll on the basis of the results of detection by the traffic-condition detecting means.

As described above, in accordance with the first aspect of the present invention, since the vehicle is notified of the range which can be reached with the present balance, an advantage can be obtained in that it is possible to notify the vehicle of effective information for coping with a balance which changes frequently.

If at least one of the exit information and the distance information is notified as the reachable range, it is possible to obtain an advantage in that the reachable range can be confirmed and the recognition of a reachable point can be accelerated.

In a case where a branching point is present in the course of travel, if exit information corresponding to each route is notified as the reachable range, it is possible to obtain an advantage in that a reachable exit can be confirmed whichever route is selected.

If the selecting means is provided for selecting at least one item of information from items of exit information corresponding to the respective routes, it is possible to obtain an advantage in that only the information on a necessary exit among a plurality of reachable exits is notified, thereby preventing confusion.

If the notification of the exit information concerning a route other than the route being traveled is stopped when the branching point has been passed, it is possible to obtain a advantage in that unnecessary information is not notified when the branching point has been passed, and it is possible to reliably and speedily ascertain a reachable exit.

If the driver is notified of the fact that the balance can be increased, it is possible to obtain an advantage in that the driver is prevented from forgetting to increase the balance.

If the calculation of the reachable range is completed when the vehicle is stopped in an area where the balance increasing device is installed, it is possible to obtain an advantage in that the driver is able to quickly confirm the reachable range when resuming driving.

If a timing at which information on the balance in the card is increased is notified, the increasing of the balance is prompted. Hence, an advantage can be obtained in that it is possible to prevent an insufficient balance at the exit.

If a toll corresponding to a past traveling history is notified, it is possible to obtain an advantage in that an accurate toll can be notified even if the toll differs depending on the past traveling history.

In addition, if the toll is calculated on the basis of either the average vehicle speed or the elapsed time, it is possible to obtain an advantage in that an accurate toll can be notified even if the toll differs depending on the average vehicle speed and the elapsed time.

The above and other objects, features and advantages of the present invention will become more apparent from the following detailed description of the invention when read in conjunction with the accompanying drawings.

BRIEF DESCRIPTION OF THE DRAWINGS

FIG. 12 is a flowchart illustrating a processing routine after passage of a branching point or the like;

FIG. 17 is a flowchart illustrating a processing routine on the vehicle-mounted device side for calculating a reachable exit gate while the vehicle is stopped in a service area;

DESCRIPTION OF THE PREFERRED EMBODIMENTS

Referring now to the accompanying drawings, a description will be given of embodiments of the present invention. In the embodiments, the present invention is applied to an automatic toll receiving apparatus for automatically receiving a toll without causing a vehicle to stop at an entrance gate and an exit gate of a toll road by determining a transit section (route) traveled by the vehicle and a vehicle type by effecting radio communication between a vehicle-mounted device (details of which will be described later) mounted on the vehicle and road devices installed on the ground such as at the entrance gate and the exit gate or the like. In the following embodiments, a description will be given of an example in which a notifying device is mounted on the vehicle.

Figure 1:
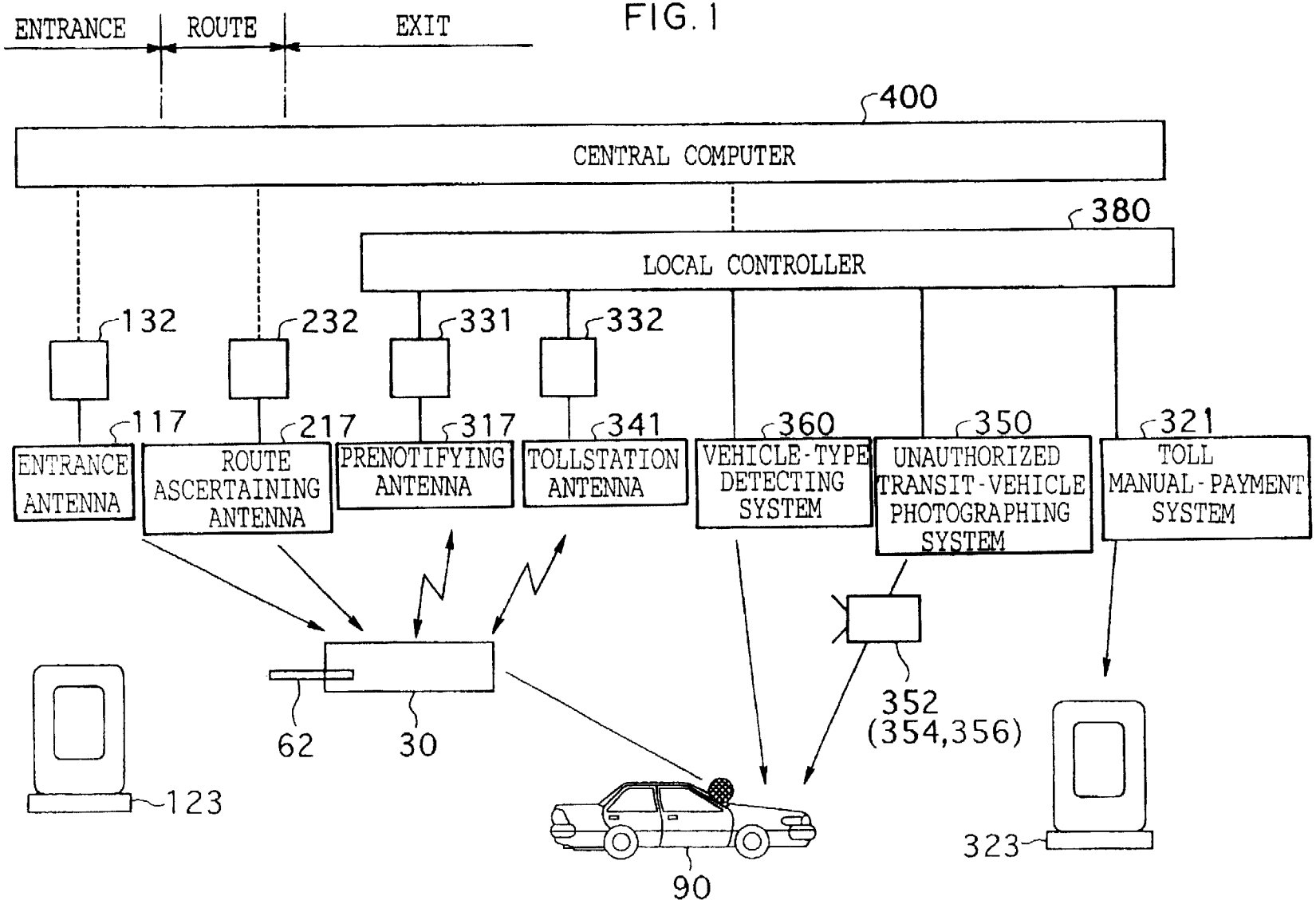
FIG. 1 is a block diagram illustrating an automatic toll receiving apparatus to which the present invention is applicable.
Figure 5:
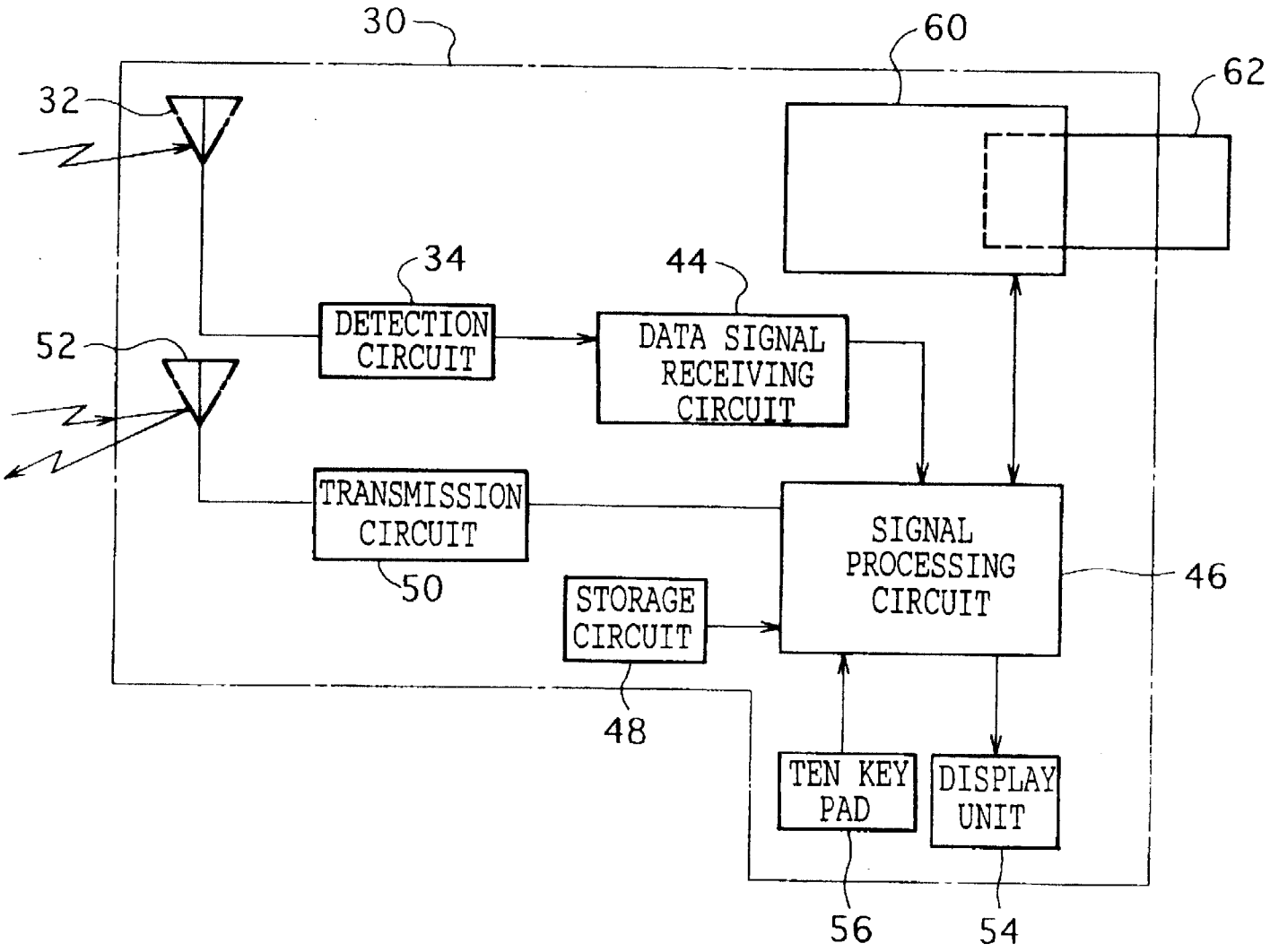
FIG. 5 is a block diagram illustrating a vehicle-mounted device in accordance with a first embodiment.

As shown in FIG. 1, a vehicle-mounted device 30 which is mounted on a vehicle 90 is provided with an IC card read/write device 60 in which an IC card 62 is removably loaded (see FIG. 5). The vehicle-mounted device 30 has a storage circuit which stores fixed data including an ID code, such as a vehicle registration number, vehicle type information, and so on. By using the IC card read/write device, the vehicle-mounted device 30 reads toll balance information from in the IC card 62 and writes toll balance information in the IC card 62.

Meanwhile, as will be described later, road devices for transmitting and receiving various items of information to and from the vehicle-mounted device 30 are respectively installed at an entrance gate 100 of a toll road, a route point 200 located such as immediately before or after a branching point, a service area, and an exit gate 300.

A road device, which includes an entrance antenna 117 constituted by a flat antenna and an entrance antenna controller 132 connected to the entrance antenna 117, is installed at the entrance gate 100. Information on the entrance gate of the toll road can be transmitted to the vehicle-mounted device 30 mounted on the vehicle by means of the entrance antenna controller 132 via the entrance antenna 117, and signals from the vehicle-mounted device 30 can be received by the entrance antenna controller 132 via the entrance antenna 117. A passage ticket issuing device 123 for issuing a passage ticket as in a conventional case is installed at the entrance gate 100 for manual payment, i.e., cash payment, of tolls for vehicles which are not adapted for automatic payment of tolls. In addition, the entrance antenna controller 132 is connected to a central computer 400 for generally controlling vehicles which approach the toll road and for other purposes.

A road device, which includes a route ascertaining antenna 217 constituted by a flat antenna and a route-ascertaining-antenna controller 232 connected to the route ascertaining antenna 217, is installed at the route point 200. Information on which route the vehicle selected at the branching point while it traveled or information on which route the vehicle traveled on the toll road (information on such as the installed position of the route-ascertaining-antenna controller) are transmitted to the vehicle-mounted device 30 by the route-ascertaining-antenna controller 232 via the route ascertaining antenna 217. In addition, the route-ascertaining-antenna controller 232 is connected to the central computer 400 so as to generally control the condition of traffic on the toll road. Two types of antennas, a prenotifying antenna 317 and a toll station antenna 341, which are constituted by flat antennas, are disposed at the exit gate 300 so as to improve the reliability in the transmission and reception of information by radio waves. A prenotifying antenna controller 331 is connected to the prenotifying antenna 317, and a toll station antenna controller 332 is connected to the toll station antenna 341. The prenotifying antenna controller 331 and the toll station antenna controller 332 are connected to a local controller 380 which, in turn, is connected to the central computer 400. The prenotifying antenna 317, the toll station antenna 341, the prenotifying antenna controller 331, and the toll station antenna controller 332 serve as road devices in accordance with the present invention, but the prenotifying antenna 317 and the prenotifying antenna controller 331 may be omitted.

Further, the following are installed at the exit gate 300: a vehicle-type detecting system 360 for determining the vehicle type by image processing or the like, an unauthorized transit-vehicle photographing system 350 to which is connected a camera 352 for photographing unauthorized transit vehicles such as vehicles passing without paying the tolls, and a toll manual-payment system 321 having a toll receipt device 323 for receiving tolls from vehicles which are not adapted for automatic payment of tolls. These systems are generally controlled by the local controller 380 to provide measures against cases such as where payment and receipt of tolls are impossible, and to automatically effect the receipt of tolls corresponding to the respective transit sections (routes) traveled by the vehicles and the types of vehicles. Also, the transmission and reception of information on the revision of a toll table and information on unauthorized transit vehicles are effected smoothly and speedily by connecting the central computer 400 and the local controller 380.

Next, a further description will be given of examples of schematic configurations of the above-described entrance gate, route point, and exit gate.

Figure 2:
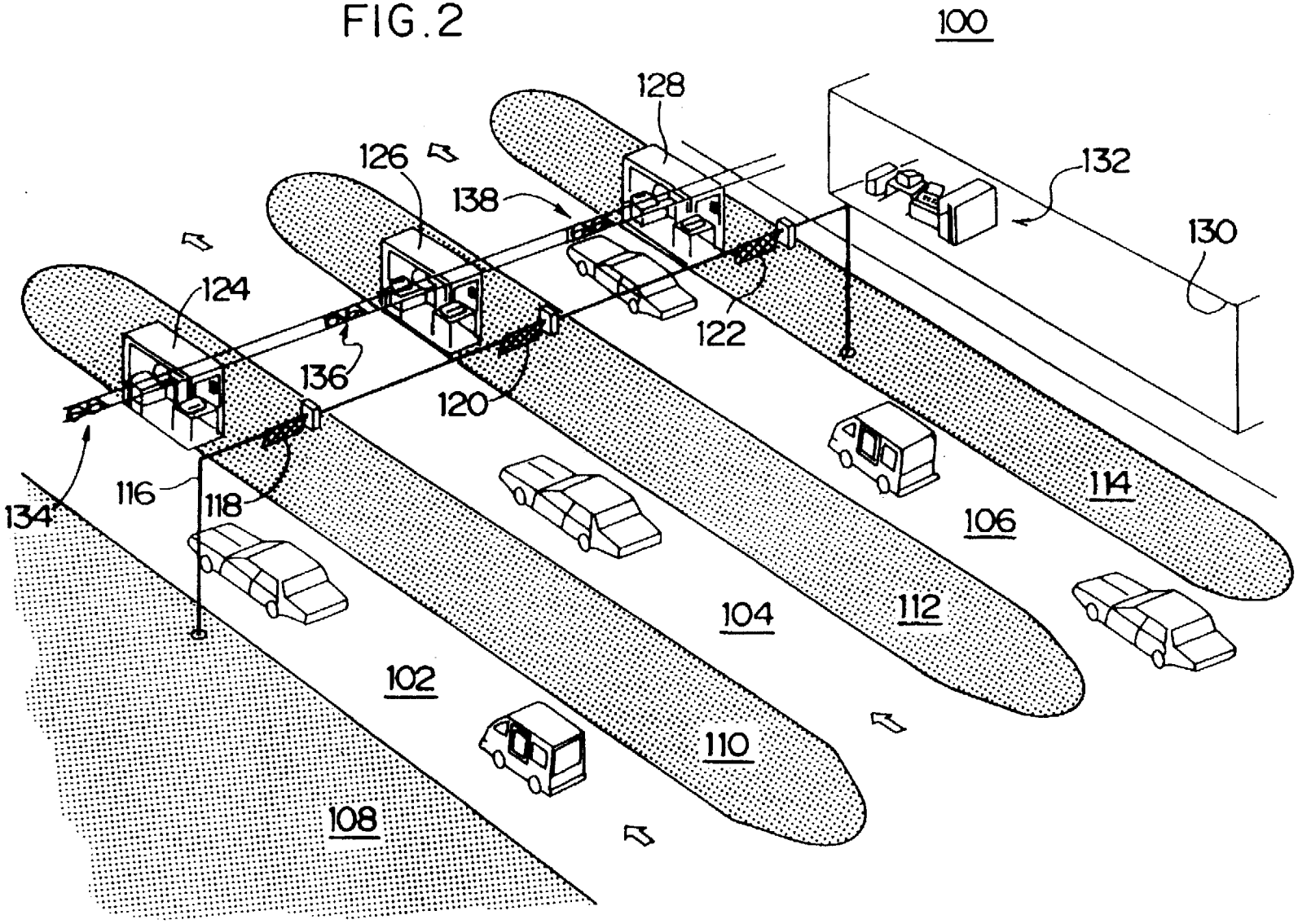
FIG. 2 is a schematic perspective view illustrating an entrance gate where the automatic toll receiving apparatus shown in FIG. 1 is installed.

As shown in FIG. 2, the entrance gate 100 of the toll road in this embodiment has three lanes 102, 104, and 106. The lane 102 is formed between a lot 108 and a separator 110, the lane 104 is formed between the separator 110 and a separator 112, and the lane 106 is formed between the separator 112 and a lot 114. An arch 116 is installed in such a manner as to extend between the lot 108 and the lot 114 and straddle these lanes, and entrance antennas 118, 120, and 122 are mounted on the arch 116 in such a manner as to be located immediate above the respective lanes. The entrance antenna 118 transmits and receives information to and from vehicles traveling in the lane 102, the entrance antenna 120 transmits and receives information to and from vehicles traveling in the lane 104, and the entrance antenna 122 transmits and receives information to and from vehicles traveling in the lane 106.

An entrance gate control center 130 having the entrance antenna controller 132 is installed in the lot 114, and the entrance antennas 118, 120, and 122 are connected to the entrance antenna controller 132.

It should be noted that although, in FIG. 2, the entrance antennas 118, 120, and 122 are used as the entrance antenna 117 shown in FIG. 1, an arrangement may be provided such that one or two lanes are used, and one or two entrance antennas are used, or a multiplicity of entrance antennas may be used.

Passage ticket issuing devices 124, 126, and 128 (correspond to the passage ticket issuing device 123 shown in FIG. 1) are installed at the entrance gate 100 for issuing passage tickets for manual payment of tolls in correspondence with the respective lanes. The passage ticket issuing device 124 is installed in correspondence with the lane 102, the passage ticket issuing device 126 is installed in correspondence with the lane 104, and the passage ticket issuing device 128 is installed in correspondence with the lane 106. These passage ticket issuing devices 124, 126, and 128 are connected to the entrance gate control center 130.

Traffic signals 134, 136, and 138 for indicating whether or not vehicles are allowed to approach the respective lanes are disposed downstream of the arch 116, as viewed in the traveling direction of the vehicles, in correspondence with the respective lanes. These traffic signals 134, 136, and 138 are connected to the entrance gate control center 130, and give either a display (e.g., a blue light) for allowing the vehicles to approach the respective lanes or a display (e.g., a red light) for not allowing the vehicles to approach the respective lanes.

The entrance antenna controller 132 of the entrance gate control center 130 is connected to the central computer 400 (see FIG. 1). Incidentally, the entrance antenna controller 132 may be provided as an independent control system using the entrance gate alone without being connected to the central computer 400.

Figure 3:
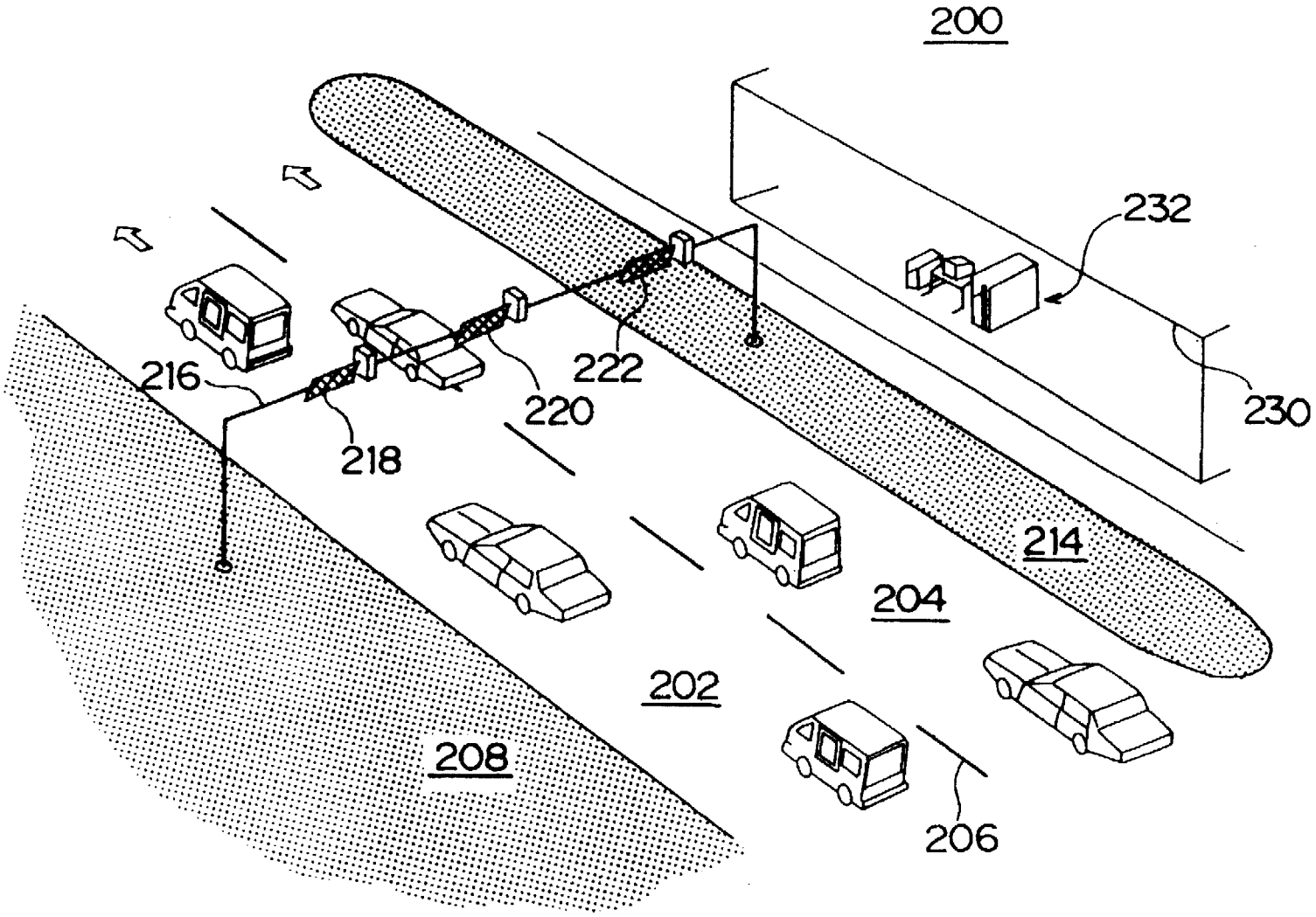
FIG. 3 is a schematic perspective view illustrating a route point where the automatic toll receiving apparatus shown in FIG. 1 is installed.

As shown in FIG. 3, two adjacent lanes 202 and 204 are formed between a lot 208 and a lot 214 at the route point 200 located immediately before a branching point of the toll road. An arch 216 is installed in such a manner as to extend between the lot 208 and the lot 214 and straddle these lanes 102 and 204, and route ascertaining antennas 218, 220, and 222 are mounted on the arch 216. The route ascertaining antenna 218 is located above the lane 202 and effects the transmission and reception of information with respect to vehicles traveling in the lane 202, and the route ascertaining antenna 222 is located above the lane 204 and effects the transmission and reception of information with respect to vehicles traveling in the lane 204. The route ascertaining antenna 220 for effecting the transmission and reception of information with respect to the vehicles is disposed between the route ascertaining antennas 218 and 222 in such a manner as to straddle the lanes 202 and 204 and above a centerline 206 indicating a boundary between the lanes 202 and 204.

A route control center 230 having the route-ascertaining-antenna controller 232 is disposed in the lot 214, and the route ascertaining antennas 218, 220, and 222 are connected to the route-ascertaining-antenna controller 232.

Figure 4:
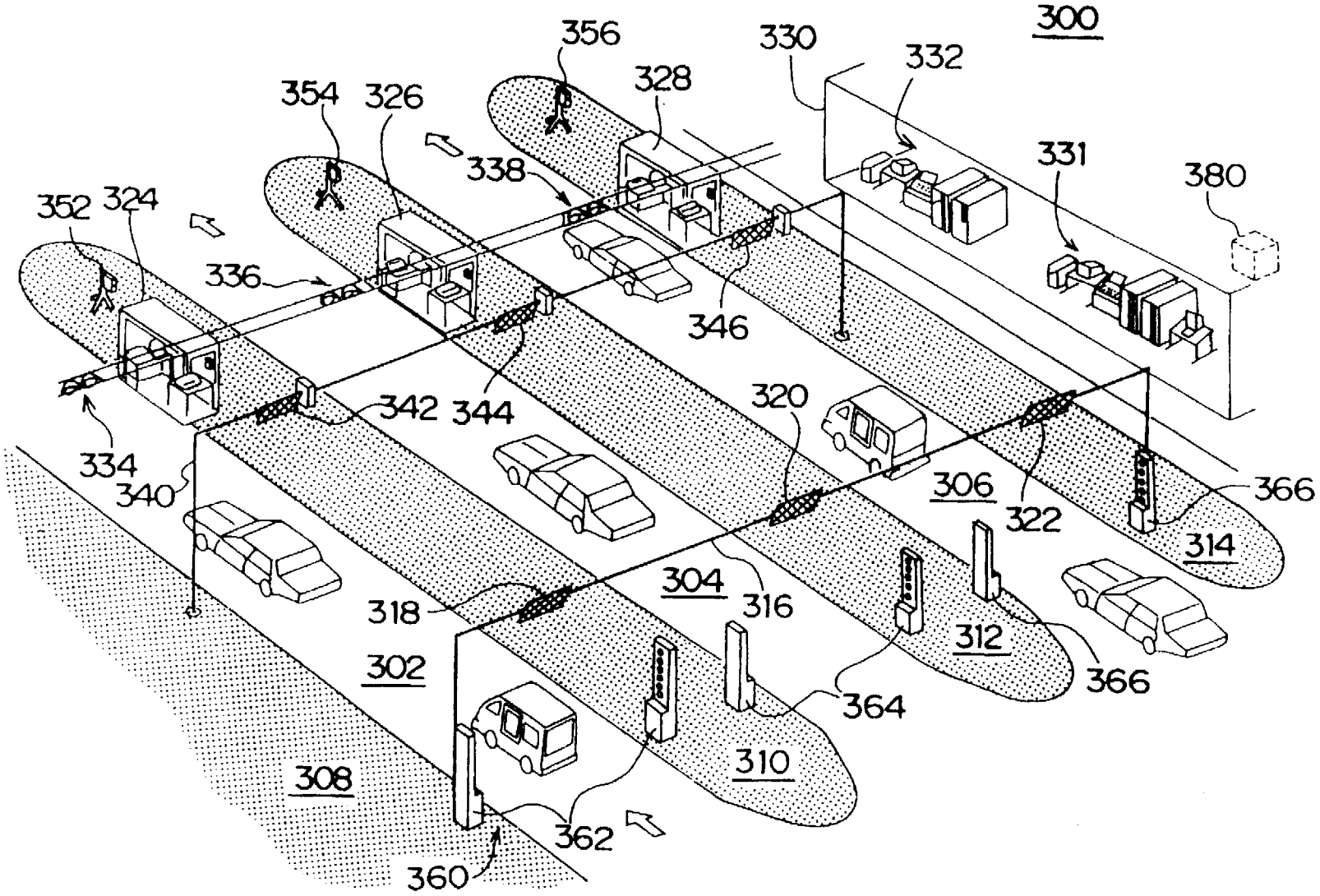
FIG. 4 is a schematic perspective view illustrating an exit gate where the automatic toll receiving apparatus shown in FIG. 1 is installed.

As shown in FIG. 4, three lanes 302, 304, and 306 are provided at the exit gate 300 of the toll road. The lane 302 is formed between a lot 308 and a separator 310, the lane 304 is formed between the separator 310 and a separator 312, and the lane 306 is formed between the separator 312 and a lot 314.

An arch 316 is installed in such a manner as to extend from the lot 308 to the lot 314 and straddle these lanes, and prenotifying antennas 318, 320, and 322 are mounted on the arch 316. The prenotifying antenna 318 is located above the lane 302 and effects the transmission and reception of information with respect to vehicles traveling in the lane 302, and the route ascertaining antenna 320 is located above the lane 304 and effects the transmission and reception of information with respect to vehicles traveling in the lane 304. Similarly, the prenotifying antenna 322 is located above the lane 306 and effects the transmission and reception of information with respect to vehicles traveling in the lane 306.

An exit gate control center 330 is installed in the lot 314, and the prenotifying antenna controller 331 and the toll station antenna controller 332 which will be described later are disposed in the exit gate control center 330. The prenotifying antennas 318, 320, and 322 are connected to the prenotifying antenna controller 331.

The vehicle-type detecting system 360 is disposed in the vicinity of the arch 316. The vehicle-type detecting system 360 has vehicle type detectors 362, 364, and 366 which are respectively constituted by CCD line scanners. The vehicle type detector 362 is disposed in the lot 308 and the separator 310, which correspond to the lane 302, so as to discriminate the types of vehicles traveling in the lane 302. Similarly, the vehicle type detector 364 is disposed in the separator 310 and the separator 312, which correspond to the lane 304, so as to discriminate the types of vehicles traveling in the lane 304, and the vehicle type detector 366 is disposed in the separator 312 and the lot 314, which correspond to the lane 306, so as to discriminate the types of vehicles traveling in the lane 306. The vehicle-type detecting system 360 which is constituted by these vehicle type detectors is connected to the local controller 380, detects the types of vehicles by determining the silhouettes of passing vehicles by image processing on the basis of images obtained by the CCD line scanners, and transmits the vehicle type information to the local controller 380.

An arch 340 is disposed in such a manner as to extend between the lot 308 and the lot 314 and straddle the aforementioned lanes, on the downstream side of the arch 316 as viewed in the traveling direction of the vehicles. Toll station antennas 342, 344, and 346 are mounted on the arch 340. The toll station antenna 342 is located above the lane 302 and effects the transmission and reception of information with respect to vehicles traveling in the lane 302, and the toll station antenna 344 is located above the lane 304 and effects the transmission and reception of information with respect to vehicles traveling in the lane 304. Similarly, the toll station antenna 346 is located above the lane 306 and effects the transmission and reception of information with respect to vehicles traveling in the lane 306. The toll station antenna controller 332 is connected to these toll station antennas 342, 344, and 346.

Toll paying boxes 324, 326, and 328 are installed in such a manner as to correspond to the respective lanes for manual payment of tolls for vehicles which are not adapted for automatic payment of tolls. The toll paying box 324 is provided in correspondence with the lane 302, the toll paying box 326 is provided in correspondence with the lane 304, and the toll paying box 328 is provided in correspondence with the lane 306. Unillustrated microcomputers are provided for the toll paying boxes 324, 326, and 328, respectively, and the toll manual-payment system 321 for controlling information on tolls received by manual payment is made up by generally controlling the unillustrated microcomputers. This toll manual-payment system 321 is connected to the local controller 380 (see FIG. 1).

The unauthorized transit-vehicle photographing system 350 for photographing unauthorized transit vehicles (see FIG. 1) is installed downstream of the toll paying boxes, as viewed in the traveling direction of the vehicles, and image forming devices 352, 354, and 356 of the unauthorized transit-vehicle photographing system 350 are provided in correspondence with the lanes 302, 304, and 306. The unauthorized transit-vehicle photographing system 350 is connected to the local controller 380.

Traffic signals 334, 336, and 338 for indicating whether or not vehicles are allowed to approach the respective lanes are disposed downstream of the arch 340, as viewed in the traveling direction of the vehicles, in correspondence with the respective lanes. These traffic signals 334, 336, and 338 are connected to the exit gate control center 330, and give either a display (e.g., a blue light) for allowing the vehicles to approach the respective lanes or a display (e.g., a red light) for not allowing the vehicles to approach the respective lanes.

The exit gate control center 330 is connected to the central computer 400 (see FIG. 1). incidentally, the exit gate control center 330 may be provided as an independent control system using the exit gate alone without being connected to the central computer 400.

Next, a description will be given of a configuration of the vehicle-mounted device 30 which is mounted on a vehicle. As shown in FIG. 5, the vehicle-mounted device 30 is provided with a receiving antenna 32 for receiving signals transmitted from a road device which will be described later. The receiving antenna 32 is connected to a detection circuit 34 for detecting modulated waves received by the receiving antenna 32 so as to obtain data signals. The detection circuit 34 is connected to a signal processing circuit 46, which is comprised of a microcomputer, via a data signal receiving circuit 44.

A storage circuit 48 for storing data such as information on ID codes, vehicle types, and the like as well as a transmission circuit 50 for transmitting the data signals and the like including ID codes as response signals are connected to the signal processing circuit 46. The transmission circuit 50 modifies an inquiry signal, i.e., an unmodulated carrier wave received by a transmitting/receiving antenna 52, by using data signals from the signal processing circuit 46, and returns the same via the transmitting/receiving antenna 52.

In addition, a display unit 54 constituted by an LCD or a CRT for displaying a reachable range and a ten key pad 56, i.e., an input means for inputting signals such as selection signals to the signal processing circuit 46, are also connected to the signal processing circuit 46.

Furthermore, the IC card read/write device 60 in which the IC card 62 is removably installed is also connected to the signal processing circuit 46.

Incidentally, electric power is constantly supplied to the vehicle-mounted device from an on-vehicle battery when an ignition switch is on.

Next, a description will be given of the road device which communicates with the vehicle-mounted device 30 by citing as an example the road device installed at the entrance gate 100. Incidentally, to simplify the description, a description will be given by using the entrance antenna 118 and the entrance antenna controller 132 for the transmission and reception of radio waves with respect to vehicles traveling in the lane 102.

Figure 6:
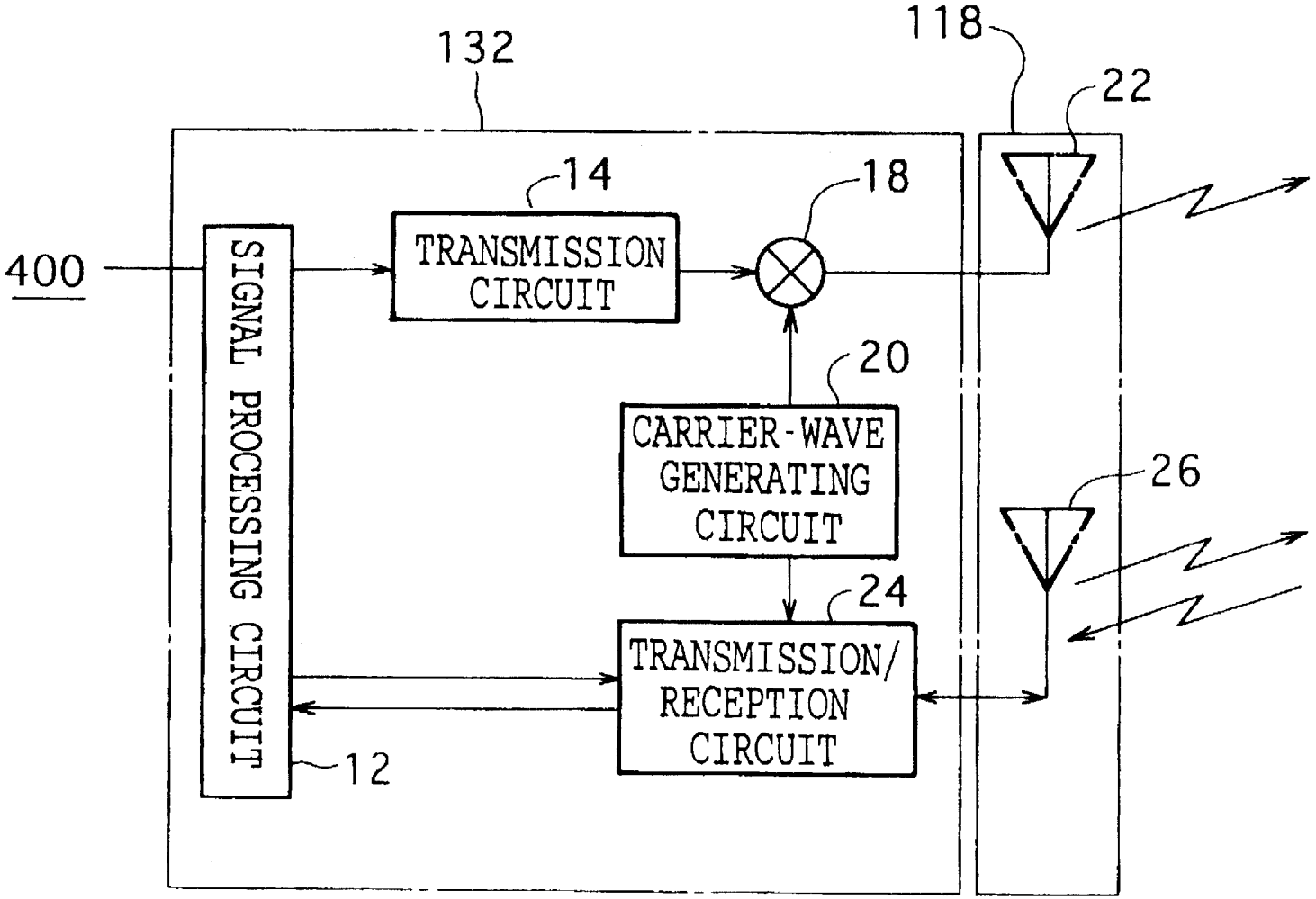
FIG. 6 is a block diagram illustrating an example of a road device.

As shown in FIG. 6, road-side devices with respect to the vehicles traveling in the lane 102 are comprised of the entrance antenna 118 and the entrance antenna controller 132. The entrance antenna 118 includes a transmitting antenna 22 and a transmitting/receiving antenna 26. The entrance antenna controller 132 has a signal processing circuit 12 comprised of a microcomputer. This signal processing circuit 12 is capable of being connected to the central computer 400. The signal processing circuit 12 is connected to a transmission circuit 14 for transmitting data signals (transmission request signals) including a command. The transmission circuit 14 is connected to the transmitting antenna 22 via a mixer 18. A carrier-wave generating circuit 20 for generating a carrier wave of a predetermined frequency is connected to the mixer 18. The mixer 18 mixes the signal inputted thereto from the transmission circuit 14 and the carrier wave inputted thereto from the carrier-wave generating circuit 20, and modulates the carrier wave, inputted thereto from the carrier-wave generating circuit 20, by the signal inputted thereto from the transmission circuit 14. The transmitting antenna 22 transmits the modulated waves as radio waves.

A transmission/reception circuit 24 is connected to the carrier-wave generating circuit 20 so as to fetch data signals from the modulated waves received by the transmitting/receiving antenna 26 after data signals are modified and returned thereto from the vehicle-mounted device 30 shown in FIG. 5.

Incidentally, since the configurations of the other entrance antennas at the entrance gate 100 are similar to the above-described configuration, a description thereof will be omitted. Also, since configurations of the respective antennas and antenna controllers at the route point 200 and the exit gate 300 are substantially similar to the above-described configurations, a description thereof will be omitted.

Next, a description will be given of a processing routine in accordance with the above-described embodiment of the present invention. In the first embodiment, exit information on the range which can be reached with the present balance is calculated as a reachable range on the basis of information on the balance in the IC card, vehicle type information, and predetermined toll information, and notifies the same to the driver.

Figure 8:
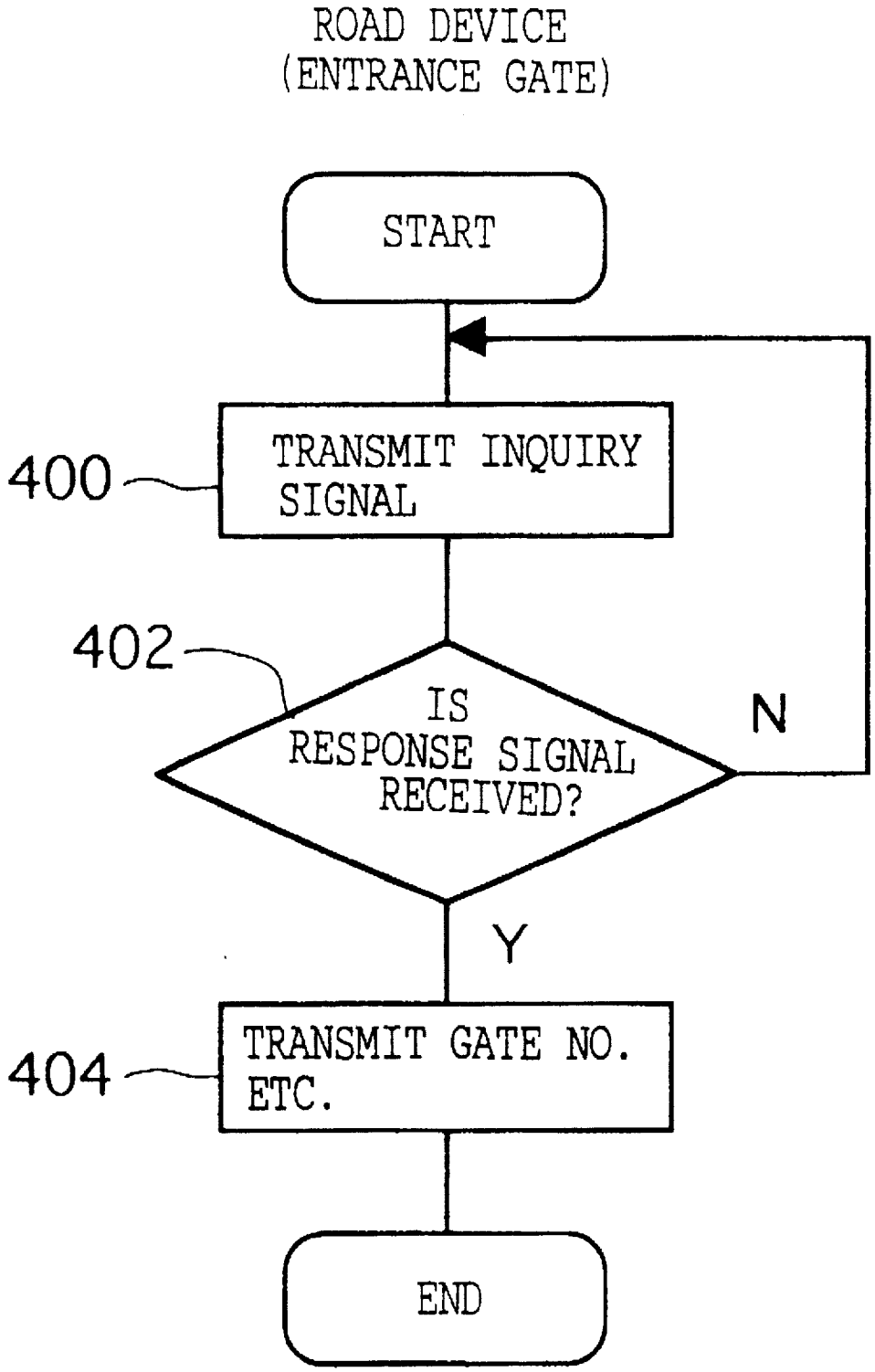
FIG. 8 is a flowchart illustrating a processing routine on the road device side in accordance with the first embodiment.

As shown in FIG. 8, in Step 400, the road device installed at the entrance gate transmits an inquiry signal constituted by continuous waves until the road device receives a response signal from the vehicle-mounted device. If it is determined in Step 402 that the response signal from the vehicle-mounted device has been received, the road device transmits a signal including an entrance gate number to the vehicle-mounted device in Step 404.

Figure 7:
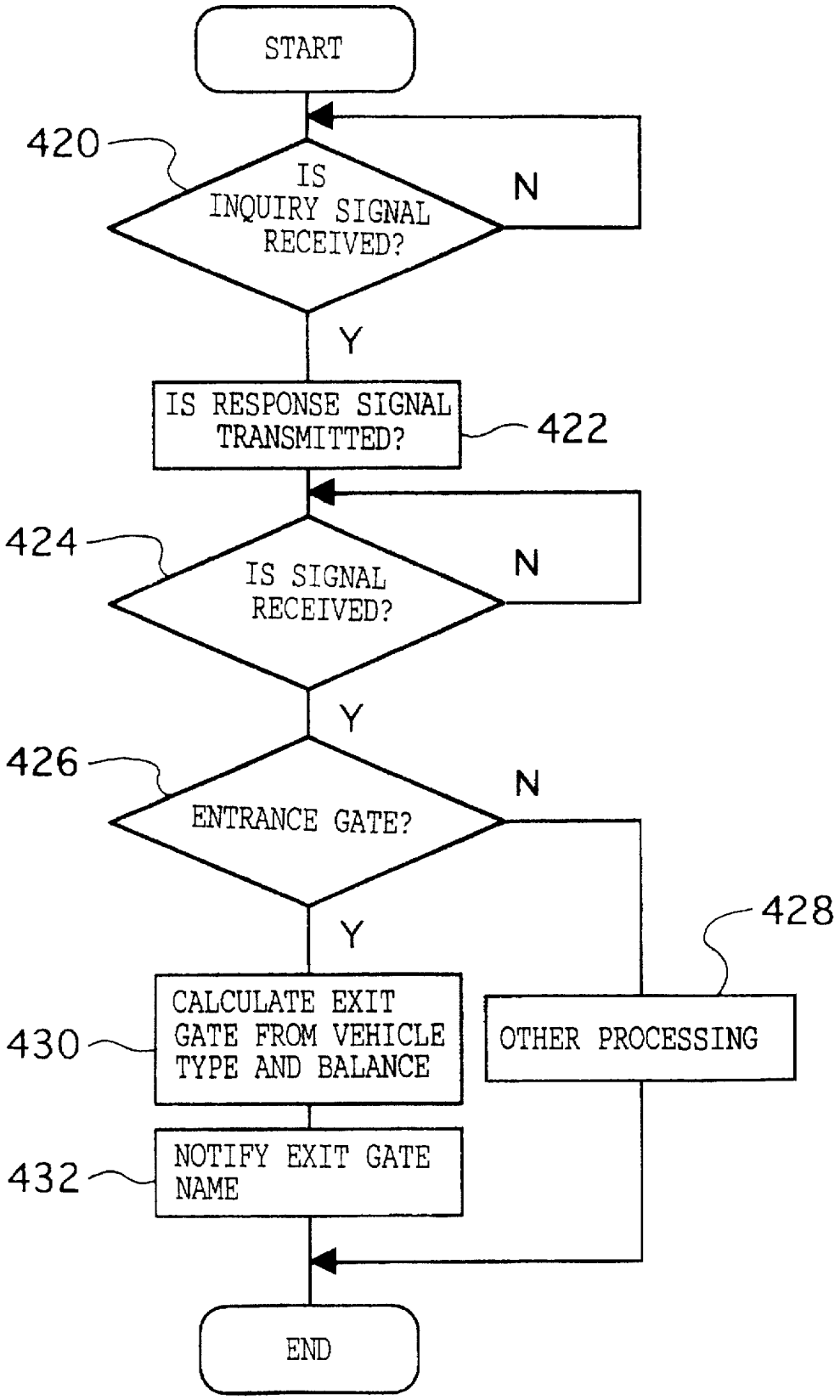
FIG. 7 is a flowchart illustrating a processing routine on the vehicle-mounted device side in accordance with the first embodiment.

FIG. 7 shows a routine for processing by the vehicle-mounted device. If it is determined in Step 420 that the vehicle-mounted device has received the inquiry signal from the road device, in Step 422, the vehicle-mounted device transmits as a response signal a modulated wave obtained by modulating a carrier wave by an ID code, i.e., an identification code for specifying the vehicle, by using the received inquiry signal as the carrier wave.

If it is determined in step 424 that the vehicle-mounted device has received the signal from the road device, a determination is made in Step 426 as to whether or not an entrance gate number is included in the received signal, so as to determine whether the vehicle is passing through the entrance gate. If the vehicle is not passing through the entrance gate, other processing (e.g., processing or the like in a service area, which will be described later) is executed in Step 428. If the vehicle is passing through the entrance gate, in Step 430, all the exit gates which can be reached with the present balance are calculated on the basis of the vehicle type information stored in the vehicle-mounted device, the balance information obtained by collating with the information stored in the IC card installed in the vehicle-mounted device, and the toll table recorded in advance in the vehicle-mounted device. Then, in Step 432, a reachable range is notified to the driver by displaying the name of an exit gate on the display unit 54 such as the LCD display unit or the CRT display unit.

Although, in this first embodiment, a description has been given of an example in which the toll table is stored in advance in the vehicle-mounted device, and a reachable exit gate is calculated, an arrangement may be alternatively provided such that the toll table is stored in advance in the road device, toll table information is transmitted to the vehicle-mounted device from the road device during transmission, so as to allow the vehicle-mounted device to calculate a reachable exit gate. In this case where the toll table is stored on the road device side, and the toll table information is transmitted from the road device to the vehicle-mounted device to calculate an exit gate, since it is unnecessary for the storage circuit of the vehicle-mounted device to store the toll table in advance at all times, it is possible to reduce the capacity of the storage circuit of the vehicle-mounted device.

In addition, in the above-described first embodiment, a description has been given of an example in which the vehicle type information is stored in the storage circuit of the vehicle-mounted device, but the vehicle type may be detected by a vehicle type detector and the vehicle type information may be transmitted from the vehicle type detector to the vehicle-mounted device.

As described above, in accordance with the first embodiment, it is possible to obtain an advantage in that, since a reachable exit gate can be confirmed at the entrance gate, in a case where a targeted exit gate cannot be reached with the present balance, the driver is able to increase the present balance at the entrance gate, or exit from the toll road at an exit gate before reaching the targeted exit gate, thereby making it possible to prevent a shortage of the balance at the exit gate where the driver exits.

Next, a description will be given of a second embodiment of the present invention. In the second embodiment, an exit gate is calculated as a reachable range by the road device side, and the reachable range is notified by the vehicle-mounted device side. Incidentally, in FIGS. 9 and 10, those portions that correspond to FIGS. 7 and 8 will be denoted by the same reference numerals, and a description thereof will be omitted.

Figure 9:
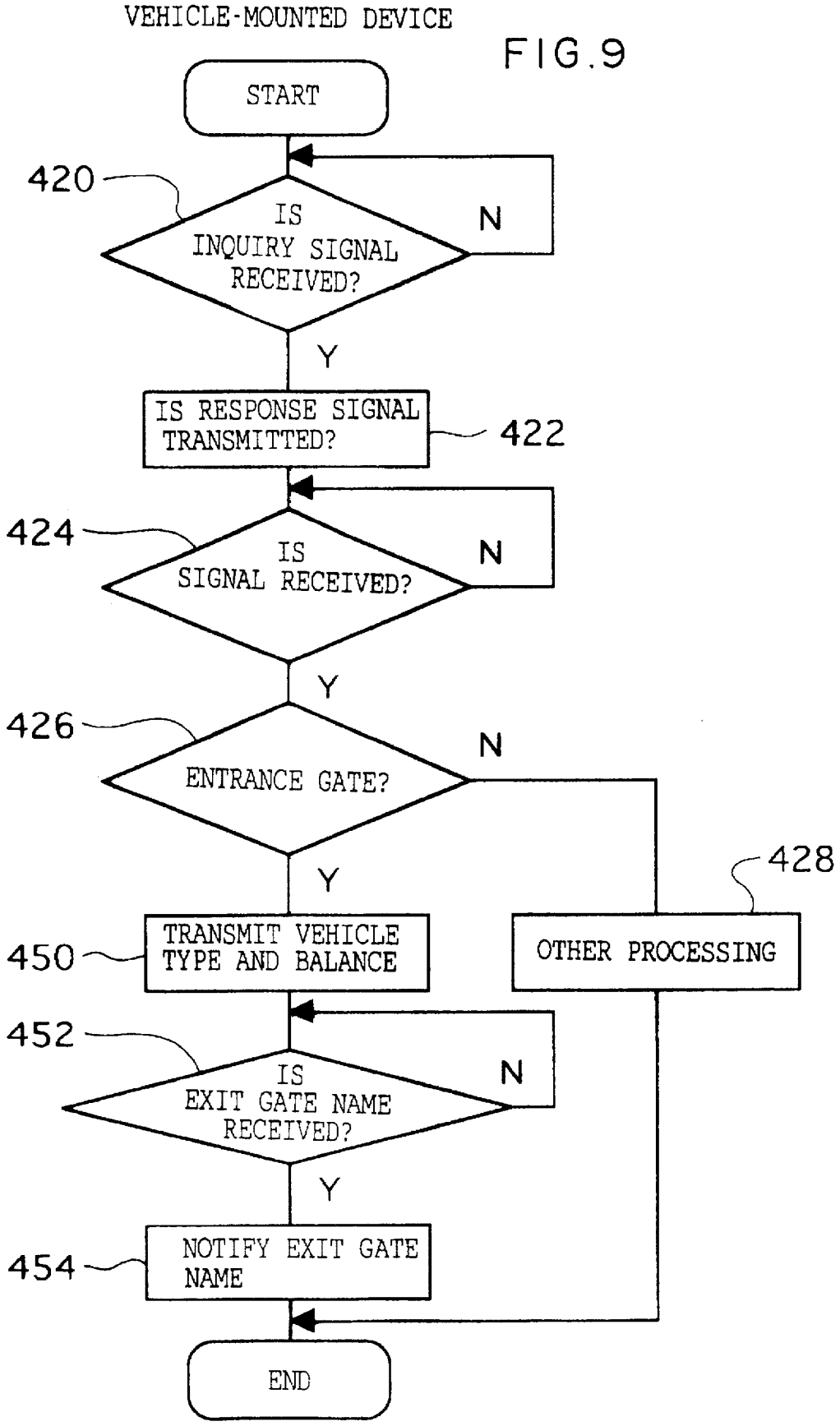
FIG. 9 is a flowchart illustrating a processing routine on the vehicle-mounted device side in accordance with a second embodiment.
Figure 10:
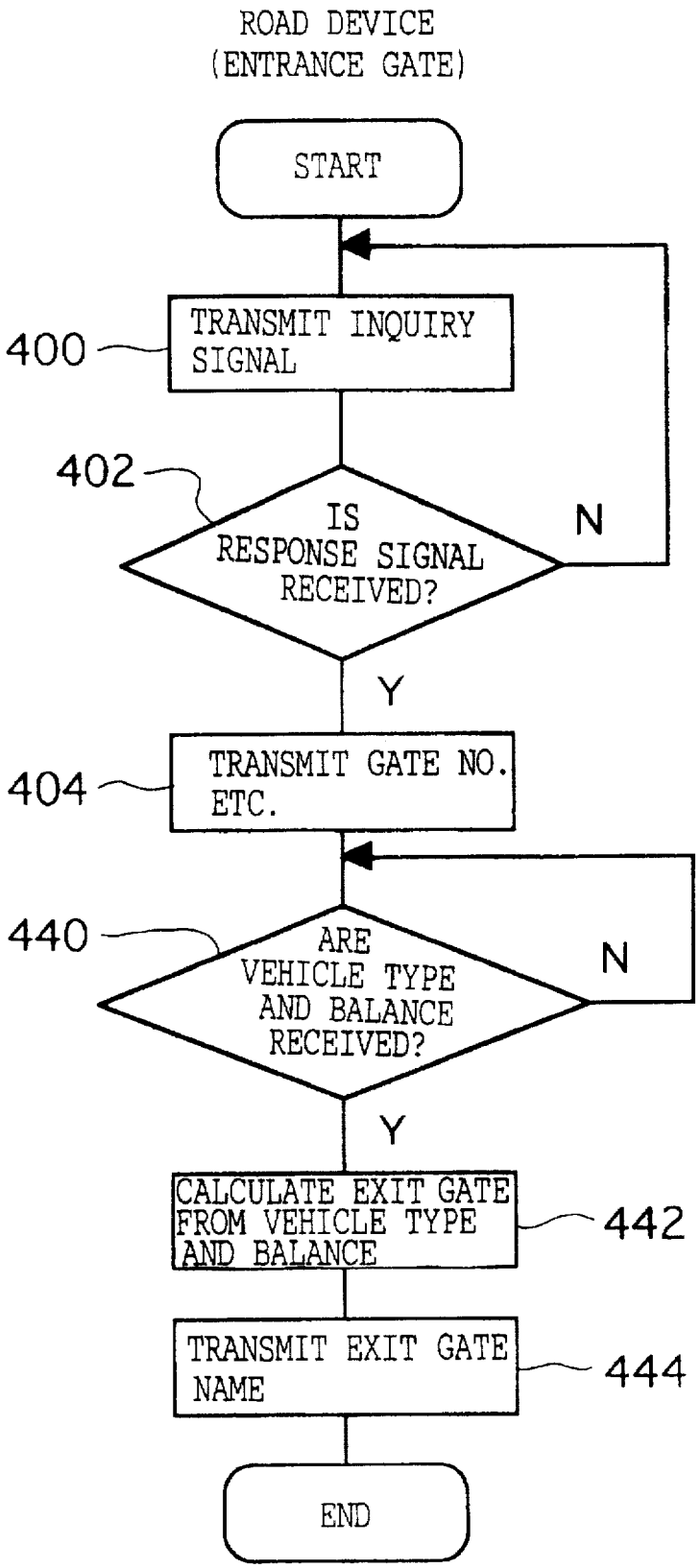
FIG. 10 is a flowchart illustrating a processing routine on the road device side in accordance with the second embodiment.

As shown in FIG. 9, if it is determined in Step 426 on the basis of the signal received by the vehicle-mounted device that the vehicle is passing through an entrance gate, in Step 450, the vehicle-mounted device transmits balance information obtained by referring to the vehicle type information stored in advance in the vehicle-mounted device and the IC card installed in the vehicle-mounted device. If it is determined in Step 452 that the exit gate name information calculated by the road device has been received, the name of the exit gate received is displayed on the display unit 54 in Step 454.

Figure 20:
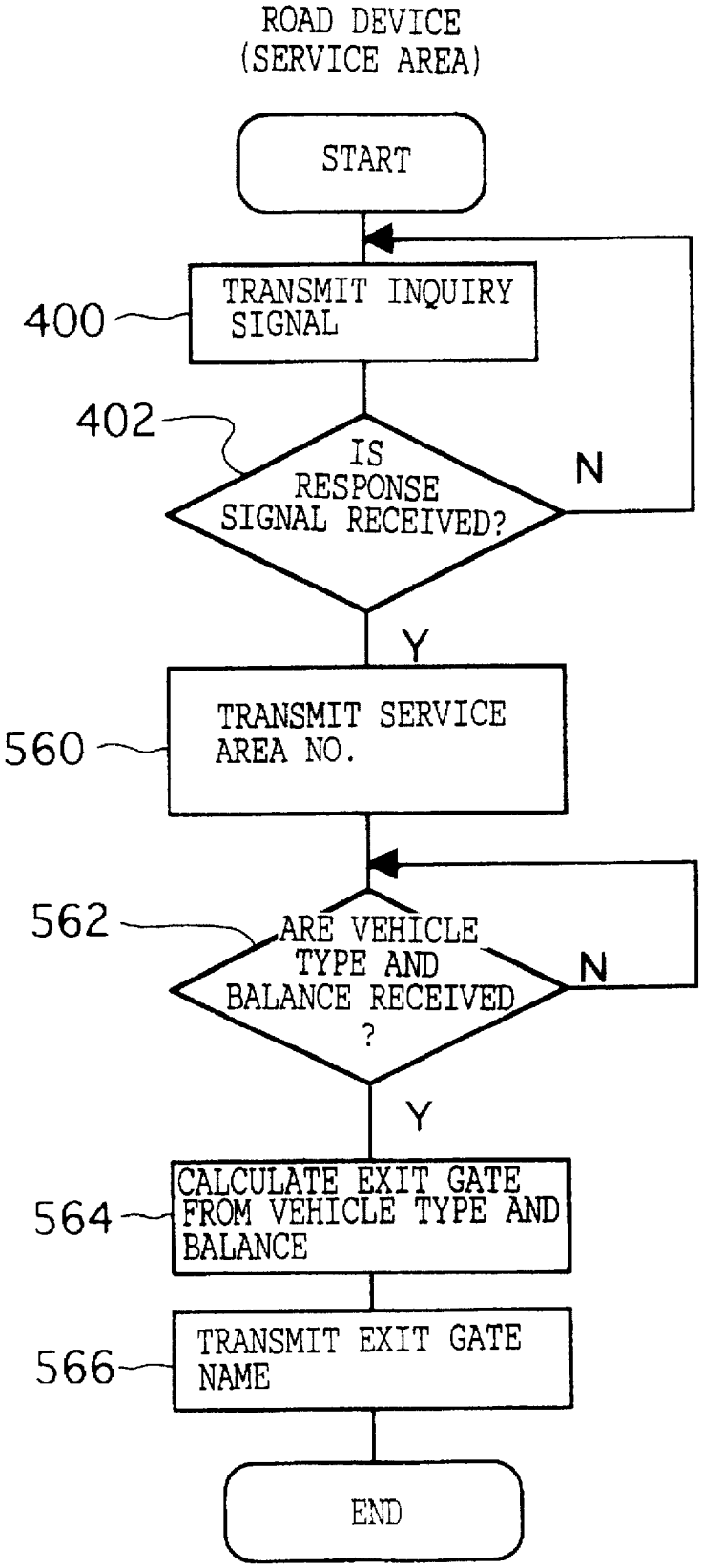
FIG. 20 is a flowchart illustrating a processing routine on the road device side.

FIG. 20 shows a routine for processing by the road device. If it is determined in Step 440 that the road device has received the vehicle type information and the balance information transmitted from the vehicle-mounted device, an exit gate which can be reached with the present balance is calculated in Step 442 on the basis of the vehicle type information and the balance information thus received as well as the toll table stored in the storage circuit of the road device. Then, the name of the exit gate is transmitted in Step 444.

Although, in this second embodiment, an example has been given in which the vehicle type information is stored in the storage circuit of the vehicle-mounted device, the vehicle type may be detected by a vehicle type detector, and the detected vehicle type information may be transmitted from the vehicle type detector to the road device.

As described above, in accordance with the second embodiment, it is possible to obtain an advantage in that since a reachable exit gate can be confirmed at the entrance gate, and the reachable range is calculated by the road device, the load on the vehicle-mounted device can be reduced, and the vehicle-mounted device can be made compact and lightweight.

Next, a description will be given of a third embodiment of the present invention. In this embodiment, in a case where a branching point is present in a traveling course, pieces of exit information corresponding to respective routes are notified as a reachable range, a selecting means is provided for selecting at least one of the pieces of exit information corresponding to the respective routes, and the notification of the exit information concerning a route other than the route relating to the route being traveled is stopped when the branching point is passed.

Figure 11:
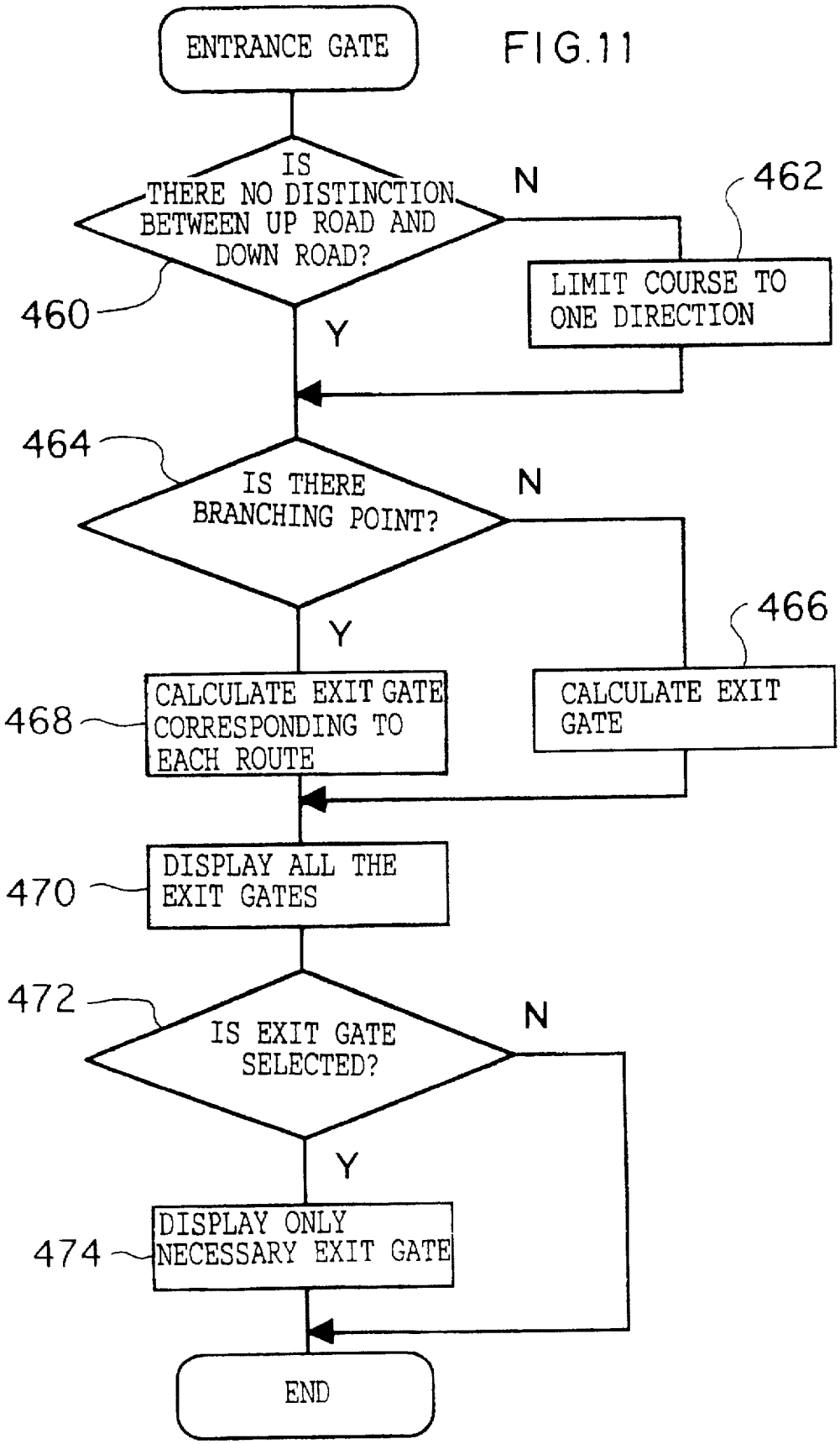
FIG. 11 is a flowchart illustrating a processing routine in accordance with a third embodiment.

FIG. 11 shows a routine for processing by the vehicle-mounted device which is executed after a response signal is transmitted at the entrance gate, and after the signal from the road device which includes an entrance gate number is received by the vehicle-mounted device. In Step 460, a determination is made as to whether or not there is a distinction between an up road and a down road in the traveling course. In a case where the route branches into an up route and a down route at the entrance gate, it is a case where there is a distinction between an up road and a down road. On the other hand, in a case where the route branches into an up route and a down route after passing the entrance gate, it is a case where there is no distinction between an up road and a down road. If there is a distinction between an up road and a down road, the route can be specified, so that, in Step 462, the course is limited to the direction of the route to be traveled, i.e., to either the up route or the down route. In Step 464, a determination is made as to whether or not a branching point is present in the course of the route to be traveled. Incidentally, if there is no distinction between the up road and the down road, since the route cannot be specified at the present point of time, a determination is made as to whether or not a branching point is present in each of the routes.

If a branching point is not present, a reachable exit gate is calculated on the basis of the stored vehicle type information, the present balance information obtained by collation, and the toll table in the same way as in the above-described first embodiment. On the other hand, if a branching point is present, in Step 468, a reachable exit gate corresponding to each route is calculated on the basis of the vehicle type information, the present balance information, and the toll table. Then, in Step 470, all the names of the calculated reachable exit gates are displayed on the display unit 54.

If there are exit gates which need not be displayed among the displayed names of the exit gates, the driver operates the ten key pad or the like provided on the vehicle-mounted device so as to select the name of the exit gate to be displayed or to select the names of the exit gates to be deleted. If it is determined in Step 472 that the name of the exit gate has been selected, only the necessary exit gate is displayed in Step 474 by deleting the names of unnecessary exit gates.

Figure 12:
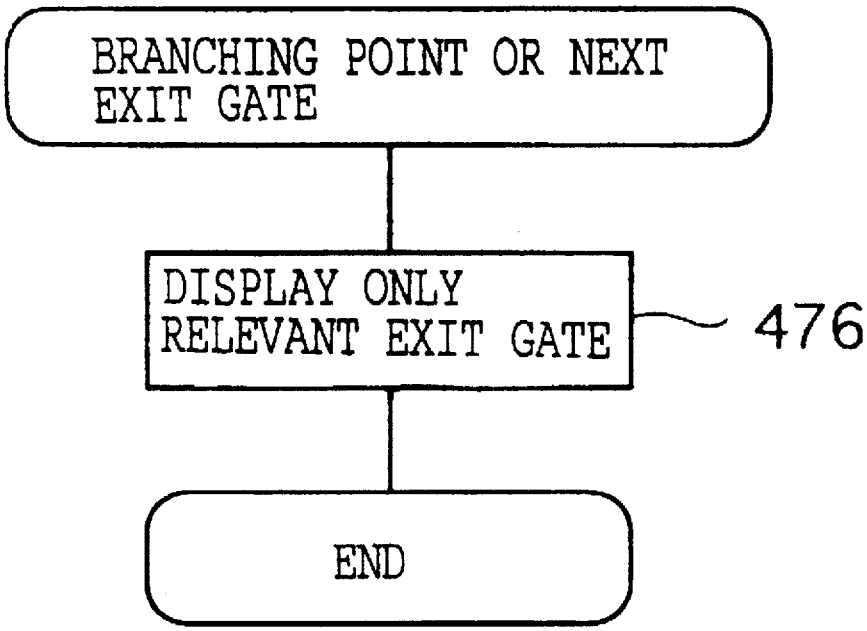

FIG. 12 shows a routine for processing by the vehicle-mounted device which is executed when a branching point is passed or the vehicle has approached a next entrance gate. In Step 476, the names of the exit gates on the route which is not traveled after passing the branching point or the entrance gate are deleted on the display unit, and only the name of the exit gate relating to the branching point which is present in the direction of the traveling route is displayed.

Incidentally, an arrangement may be alternatively provided such that the exit gate which can be reached with the present balance is calculated by the road device as shown in the second embodiment, is transmitted from the road device to the vehicle-mounted device, and is displayed on the vehicle-mounted device.

As described above, in accordance with the third embodiment, it is possible to obtain advantages in that since the name of the exit gate corresponding to the branched route is displayed, a reachable exit gate can be confirmed whichever a route is traveled, and since only the name of a necessary exit gate is displayed on the display unit due to selection or the passage of a branching point, visual confirmation is facilitated.

Although, in the above-described embodiment, a description has been given of an example in which the presence or absence of a branching point is determined at the entrance gate so as to display an exit gate, an arrangement may be alternatively provided such that the presence or absence of a branching point is determined at a junction of the expressway, and an exit gate is calculated in accordance with the presence or absence of the branching point so as to display the exit gate.

Next, a description will be given of a fourth embodiment of the present invention. In this embodiment, in a case where the vehicle has advanced into a service area, and a balance-increasing device for increasing the balance in the IC card by paying cash is installed in the service area, the position of the balance-increasing device and an increasing timing are notified to the driver.

A road device similar to the road device installed at an entrance gate is installed in the service area. This road device may be fixedly installed in the service area, or may be of a mobile type in which the road device is mounted in a vehicle or the like and circulates along a predetermined route in the service area.

Figure 14:
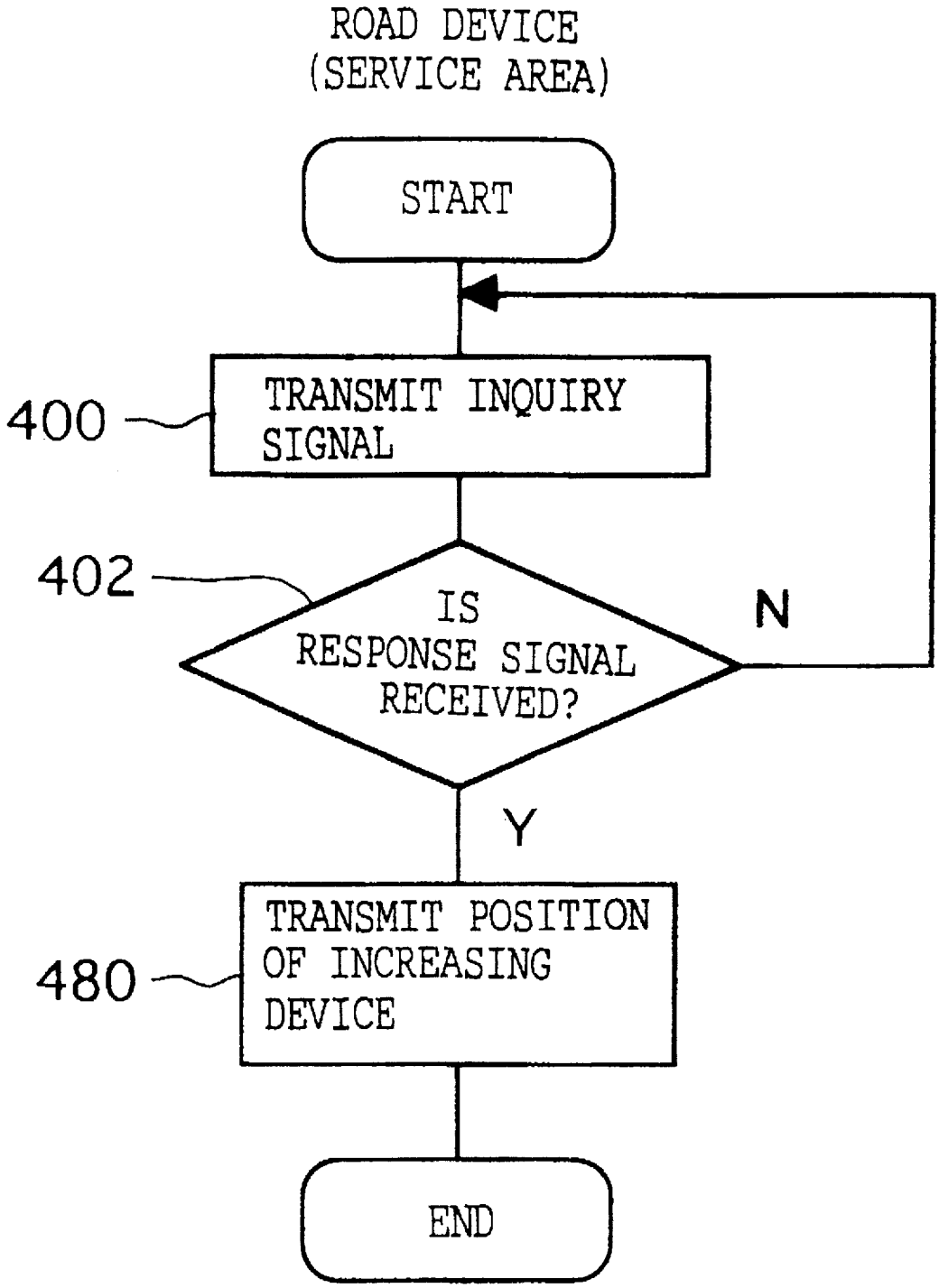
FIG. 14 is a flowchart illustrating a processing routine on the road device side in accordance with the fourth embodiment.

As shown in FIG. 14, when the road device transmits an inquiry signal and receives a response signal from the vehicle-mounted device, i.e., when the vehicle equipped with the vehicle-mounted device advances into the communication area of the road device, in Step 480, information on the position of the balance-increasing device, the road device transmits the number of the service area, and the like. In this case, the road device may transmit only the information on the position of the balance-increasing device installed in the service area, or may transmit information including information on the positions of all the balance-increasing devices which are installed in the service areas located along the route which is to be traveled from now.

Figure 13:
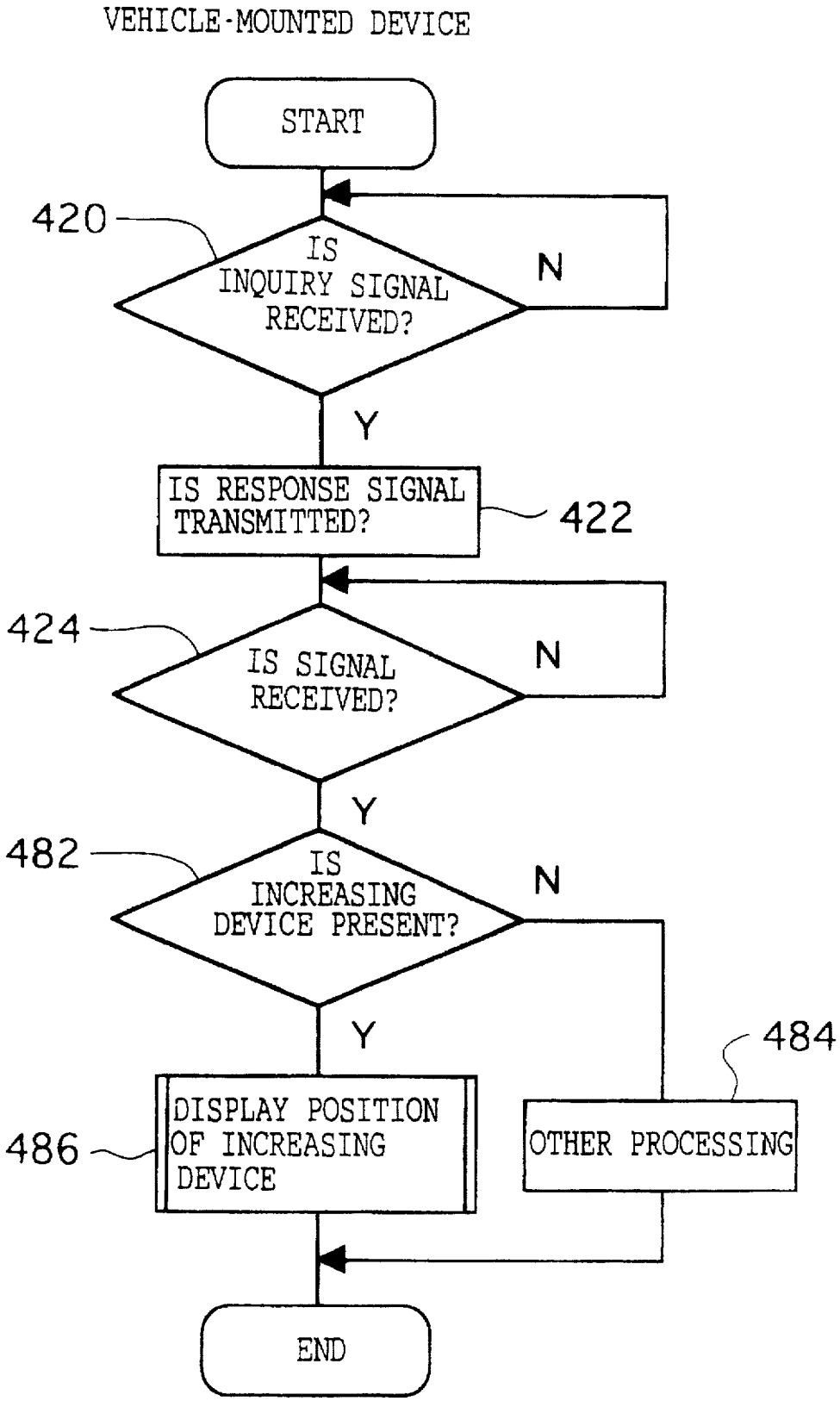
FIG. 13 is a flowchart illustrating a processing routine on the vehicle-mounted device side in accordance with a fourth embodiment.

As shown in FIG. 13, when the vehicle-mounted device receives the signal from the road device in Step 424, a determination is made in Step 424 on the basis of the received signal as to whether or not the balance-increasing device is installed. If the balance-increasing device is installed, in Step 486, the position of the balance-increasing device is displayed to indicate the fact of the balance-increasing device being installed and an increasing timing. Consequently, by causing the information on the balance in the IC card to be displayed on the display unit by operating the ten key pad, the driver is able to confirm the balance information and confirm whether or not it is necessary to increase the balance. If it is necessary to increase the balance, the driver removes the IC card from the vehicle-mounted device, loads the IC card in the balance-increasing device, and deposits cash into the balance-increasing device, thereby making it possible to increase the balance by the balance-increasing device.

Figure 15:
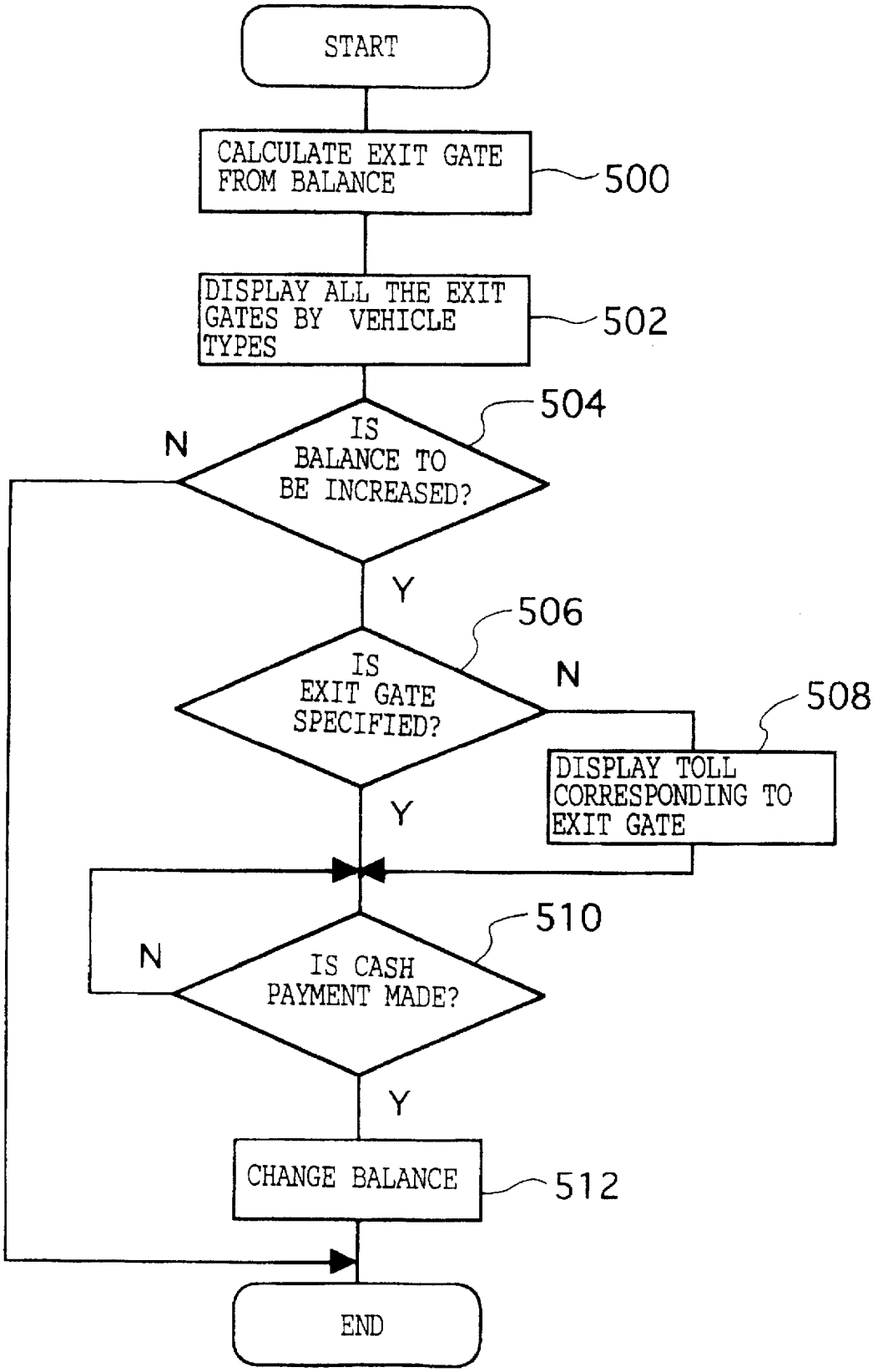
FIG. 15 is a flowchart of a routine which illustrates balance-increasing processing.

FIG. 15 shows an example of a processing routine for increasing the balance in the IC card by using a cash register as the balance-increasing device. The cash register is provided with a RAM, a CPU, and a ROM in which the program of the processing routine shown in FIG. 15 is stored.

When the IC card is removed from the vehicle-mounted device and is loaded in the cash register, in Step 500, the cash register reads balance information from the IC card and calculates an exit gate which can be reached with the balance thus read. In this case, the vehicle type information is stored in the storage circuit of the vehicle-mounted device, and is not recorded in the IC card, so that reachable gates are calculated for the up route and the down route, respectively, with respect to various vehicle types including ordinary vehicles, large-size vehicles, and medium-size vehicles. In an ensuing Step 502, all the exit gates corresponding to the vehicle types, the down route, and the up route are displayed on the display unit, such as the LCD or the CRT, provided in the cash register.

The driver confirms the display on this display unit, and if the balance information is to be increased, the driver informs the operator of the cash register to that effect, and the operator operates the ten key pad provided on the cash register to input information for increasing the balance information. In Step 504, a determination is made as to whether or not the information for increasing the balance information has been inputted so as to change the information on the balance in the IC card. That is, a determination is made as to whether the balance is to be increased, and if it is to be increased, a determination is made in Step 506 as to whether or not an exit gate has been specified. If an exit gate has been specified, a toll corresponding to the specified exit gate is displayed in Step 508.

If a cash payment is made, keys are operated on the cash register to input the amount. In an ensuing Step 510, a determination is made as to whether a cash payment has been made, if the cash payment has been made, the balance information corresponding to the paid cash is increased in Step 512 and is recorded in the IC card.

Figure 16:
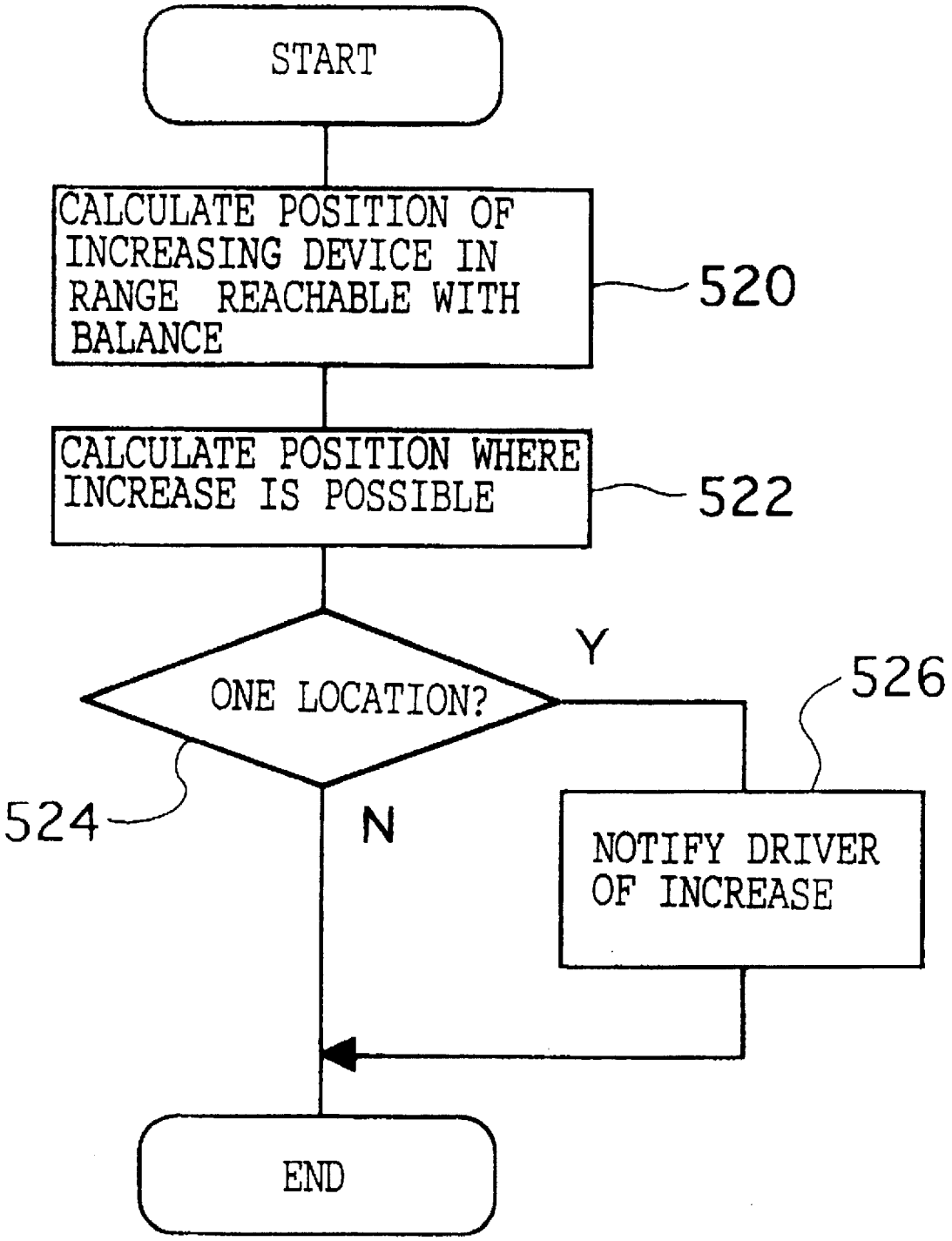
FIG. 16 is a flowchart of a routine for notifying a timing of increasing the balance.

FIG. 16 shows the details of Step 486 in FIG. 13. In Step 520, the position of a balance-increasing device which is located along the route up to an exit gate reachable with the present balance is calculated on the basis of the received information on the position of the balance-increasing device and the balance information collated with. In an ensuing Step 522, a determination is made on the basis of the present time and the time required for reaching the calculated position where the balance-increasing device is installed as to whether or not the balance-increasing device is usable when the vehicle arrives there. That is, the installed position of the balance-increasing device where increase is possible is calculated, excluding a balance-increasing device which cannot be used due to the store being closed or for another reason. Incidentally, as the required time, an average time is set in advance.

In Step 524, a determination is made as to whether the number of installed positions of the balance-increasing devices where increase is possible is a predetermined number (e.g., one). If the number of the installed positions is the predetermined number, it is impossible to increase the balance if that installed position of the balance-increasing device is passed. Therefore, the installed position of the balance-increasing device is displayed in Step 526, thereby notifying the driver to increase the balance in the IC card. Incidentally, in this case, it is preferable to notify the driver by jointly using speech so as to positively notify the driver.

Although, in this embodiment, a description has been given of the example in which the position of the balance-increasing device is displayed so as to indicate the fact of the balance-increasing device being installed and the increasing timing, only the fact of the balance-increasing device being installed or only the increasing timing may be notified by means of speech, an icon, the position of the balance-increasing device, or the like.

As described above, in accordance with the fourth embodiment, it is possible to obtain an advantage in that since the position of the balance-increasing device and the increasing timing are notified to the driver, the driver is prevented from forgetting to increase the balance.

Next, a description will be given of a fifth embodiment of the present invention. In this embodiment, a reachable exit gate is calculated by the vehicle-mounted device side when the vehicle is stopped. In this embodiment, the road device is installed in the service area. The road device may be fixedly installed in the service area, or may be of a mobile type in which the road device is mounted in a vehicle or the like and circulates along a predetermined route in the service area.

Figure 18:
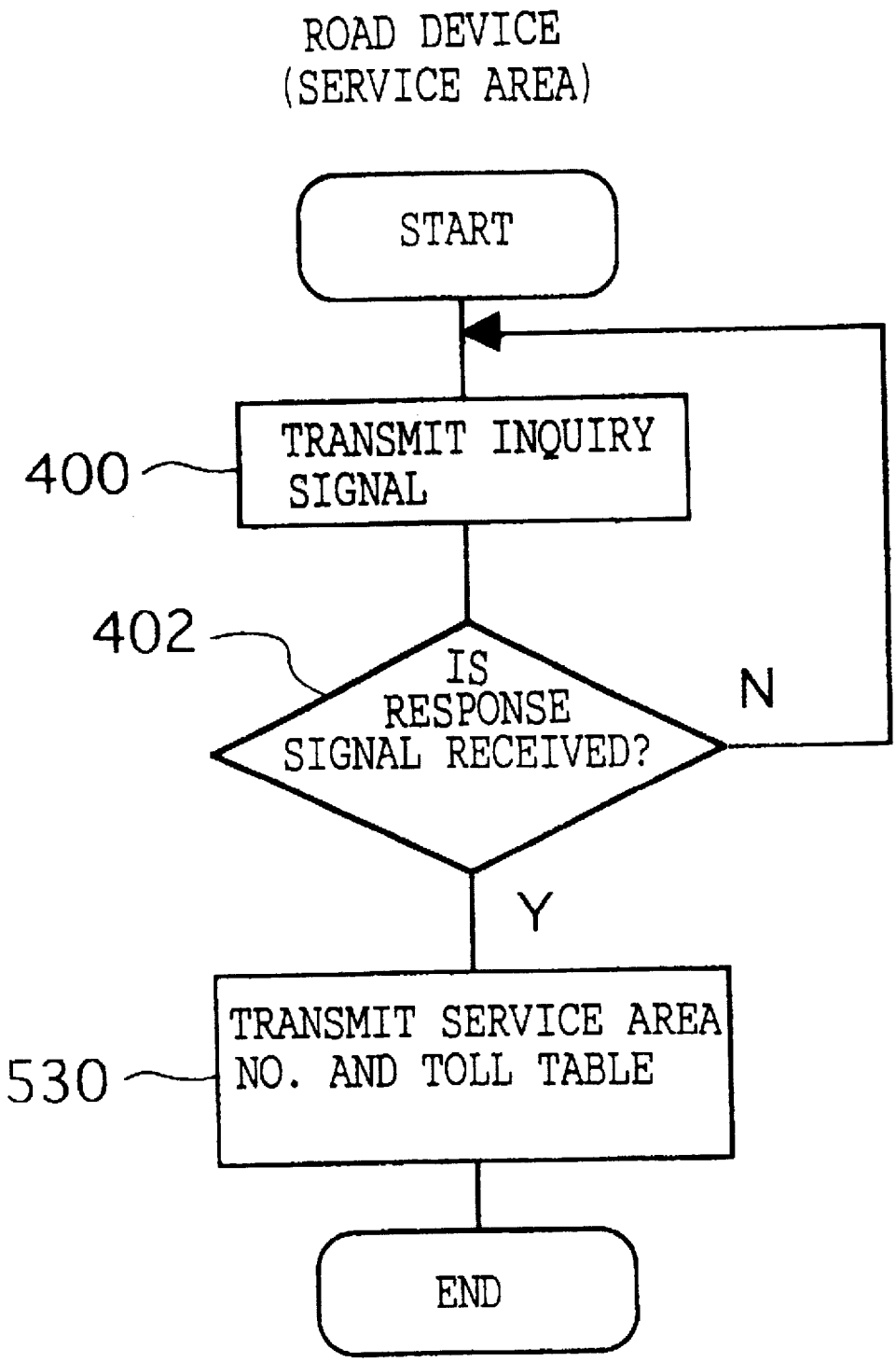
FIG. 18 is a flowchart illustrating a processing routine on the road device side.

As shown in FIG. 18, if it is determined that a response signal from the vehicle-mounted device has been received by the road device, in Step 530, the service area number (positional information indicating the position of the service area) and the toll table are transmitted.

As shown in Steps 532 and 534 in FIG. 17, the vehicle-mounted device determines whether an inquiry signal from the road device has been received for each predetermined time in a power-saving mode. If it is determined that the inquiry signal from the road device has been received, in Step 536, the power of the vehicle-mounted device is turned on, and a response signal is transmitted. If it is determined in Step 538 that the signal from the road device has been received, in Step 540, information on the service area number and the toll table transmitted from the road device is stored, and the power of the vehicle-mounted device is turned off. By turning the power of the vehicle-mounted device on and off in the above-described manner, it is possible to prevent the consumption of the battery when the vehicle is stopped.

In Step 542, a determination is made as to whether or not the ignition switch has been turned on. If the ignition switch is on, a determination is made in Step 544 as to whether or not the service area number has been stored in the vehicle-mounted device so as to determine whether the vehicle-mounted device is stopped in the service area. If the vehicle is stopped in the service area, a determination is made in Step 548 as to whether or not the IC card is loaded in the vehicle-mounted device. The reason why the determination is made here as to whether or not the IC card is loaded is because there are cases where the IC card is removed from the vehicle-mounted device and is used for shopping in a store or the like or for increasing the balance.

If it is determined in Step 548 that the IC card is loaded, in Step 550, an exit gate which can be reached with the present balance is calculated on the basis of the vehicle type information, the balance information, and the toll table. In Step 552, the name of the exit gate is notified by being displayed on the display unit, and information on the service area number and the toll table is deleted. Since only several milliseconds or thereabouts is required for calculating the reachable exit gate, the reachable exit gate is calculated and the name of the exit gate is notified substantially at the same time as the ignition switch is turned on, i.e., while the vehicle is stopped.

As described above, in accordance with the fifth embodiment, since an exit gate which can be reached with the present balance is calculated by effecting communication while the vehicle is stopped, it is possible to transmit and receive much data in comparison with the time when the vehicle is traveling. Consequently, it is possible to obtain an advantage in that data can be transmitted and received reliably.

Next, a description is given of a sixth embodiment of the present invention. In this embodiment, a reachable exit gate is calculated on the road device side while the vehicle is stopped, and the reachable exit gate is notified by the vehicle-mounted device.

FIG. 20 shows a routine for processing by a fixed road device or movable road device installed in a service area. If it is determined in Step 402 that the response signal from the vehicle-mounted device has been received, information on the service area number is transmitted in Step 560. In Step 562, a determination is made as to whether or not the vehicle type information and the balance information transmitted from the vehicle-mounted device have been received. If YES is the answer in the determination in Step 562, an exit gate which can be reached with the present balance is calculated in Step 564 on the basis of the vehicle type information, the balance information, and the toll table. In Step 566, the name of the exit gate thus calculated is transmitted.

Figure 19:
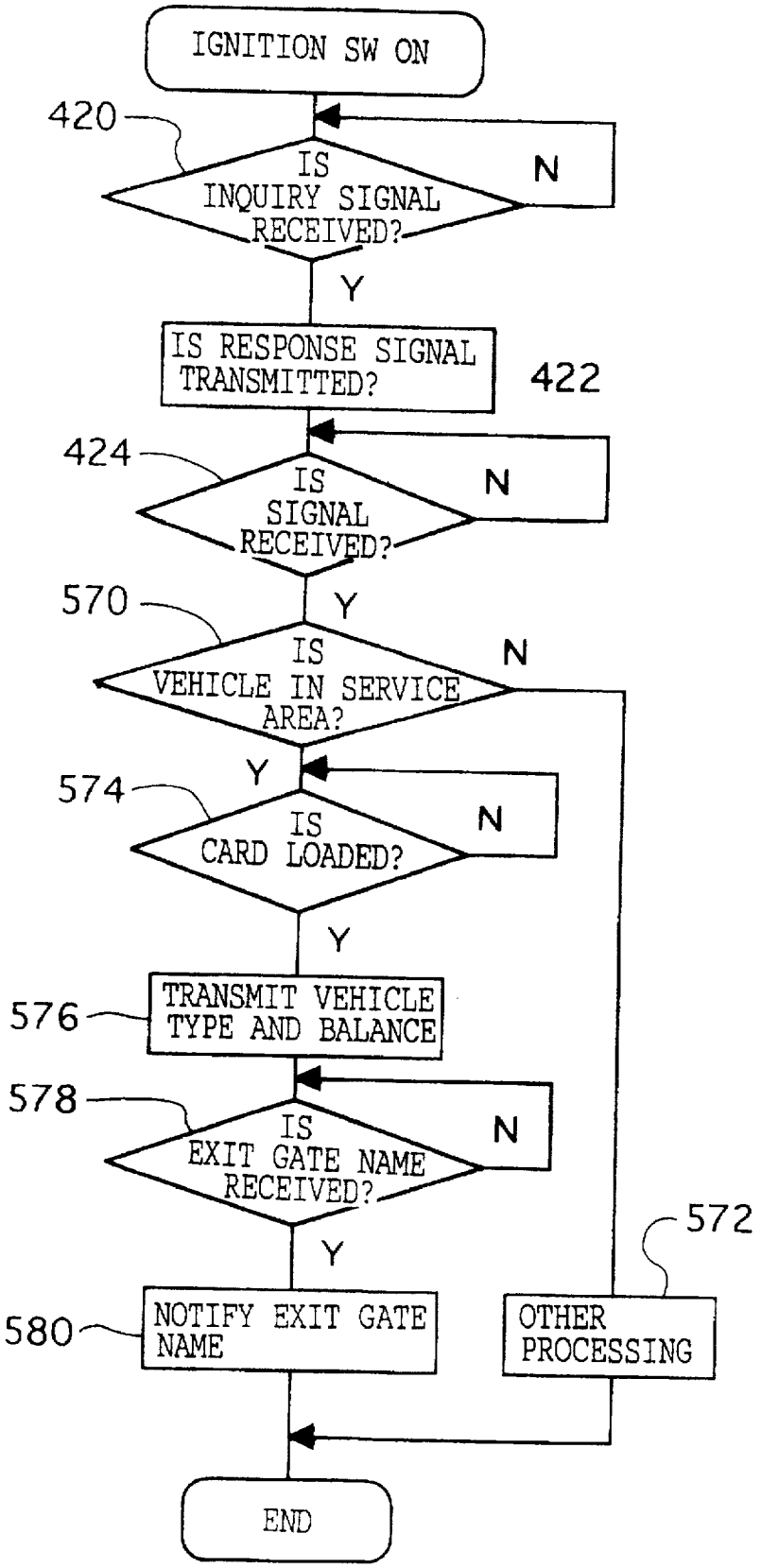
FIG. 19 is a flowchart illustrating a processing routine on the vehicle-mounted device side for calculating a reachable exit gate by the road device located in the service area.

FIG. 19 shows a routine for processing by the vehicle-mounted device which is executed at the same time as the ignition switch is turned on. After a response signal is transmitted upon receiving the inquiry signal from the road device, and the signal from the road device is received, a determination is made in Step 570 on the basis of the received signal as to whether or not the vehicle is stopped in the service area. If it is determined that the vehicle is stopped in the service area, a determination is made in Step 574 as to whether or not the IC card is loaded in the vehicle-mounted device. If the IC card is loaded, in Step 576, the vehicle type information and the present balance information obtained by referring to the IC card are transmitted to the road device. Upon receiving this signal, in the aforementioned Step 564, the road device calculates an exit gate which can be reached with the present balance, and transmits the name of the calculated exit gate in Step 566. If it is determined in Step 578 that the name of the exit gate has been received, in Step 580, the name of the exit gate is displayed on the display unit of the vehicle-mounted device.

Although, in the above-described sixth embodiment, a description has been given of the example in which the vehicle type information is stored in the storage circuit of the vehicle-mounted device, an arrangement may be alternatively provided such that a vehicle type detector is installed in the service area, and information on the vehicle type detected by the installed vehicle type detector is transmitted from the vehicle type detector to the road device.

Figure 22:
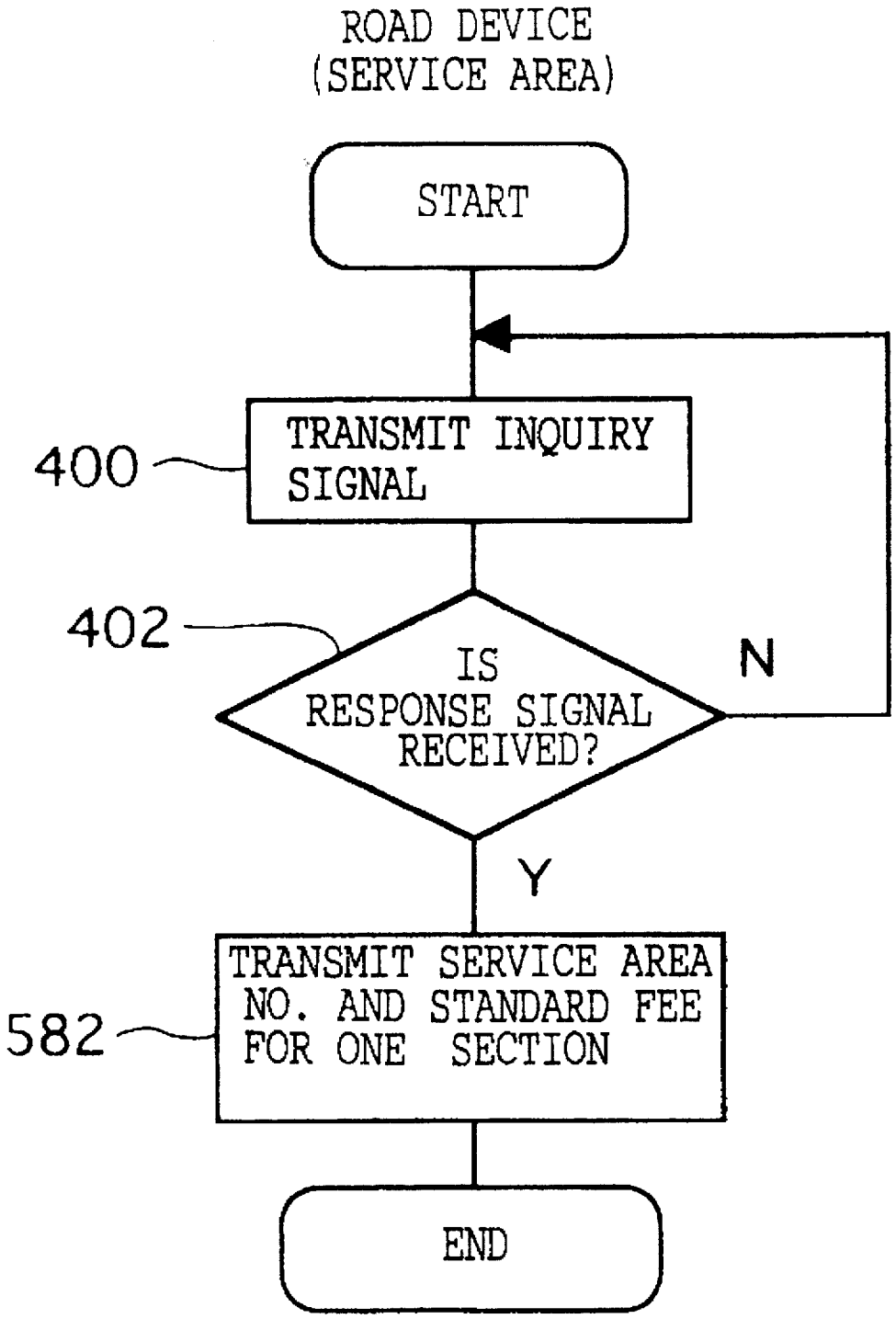
FIG. 22 is a flowchart illustrating a processing routine on the road device side.

Next, a description will be given of a seventh embodiment of the present invention. In this embodiment, a toll for the section or sections which have been traveled up to now is calculated on the vehicle-mounted device side, and the toll for the section or sections traveled up to now is subtracted from the present balance information, and is notified to the driver. As shown in FIG. 22, upon receiving the response signal from the vehicle-mounted device, in Step 582, the road device transmits information on the service area number and data indicating a standard fee for one section.

Figure 21:
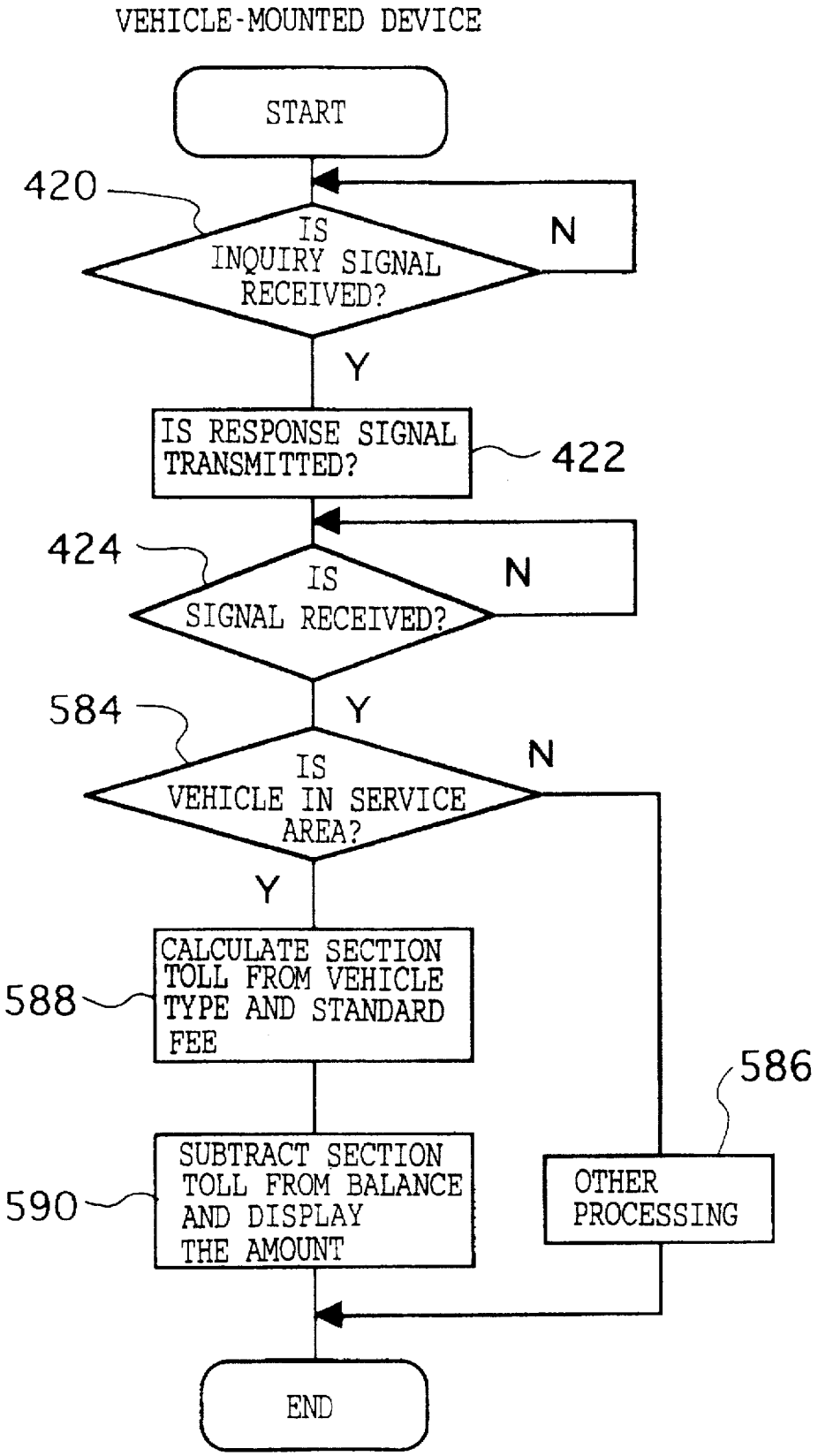
FIG. 21 is a flowchart illustrating a processing routine on the vehicle-mounted device side for illustrating a routine for displaying a balance corresponding to the traveled section or sections.

As shown in FIG. 21, in Step 424, the vehicle-mounted device determines on the basis of the received signal whether or not the vehicle is stopped in the service area or is moving in the service area. If the vehicle is not in the service area, other processing is carried out. On the other hand, if it is determined that the vehicle is in the service area, in Step 588, a section toll which is a toll for the section or sections which have been traveled up to now is calculated on the basis of the stored vehicle type information, a standard fee for one section transmitted from the road device, and information on the section or sections which have been traveled up to now. If the entrance gate number, which shows a past traveling history, and the number of the service area where the vehicle stopped in the past are stored in advance, the information on the section or sections which have been traveled up to now can be determined from the stored entrance gate number and service area number as well as the number of the service area where the vehicle is presently located.

Then, in Step 590, a difference obtained by subtracting the calculated section toll from the present balance information is displayed as new balance information. .As a result, it is possible to display a balance corresponding to the route which has been traveled.

As described above, in accordance with the seventh embodiment, since the balance corresponding to the section or sections which have been traveled up to now can be displayed, an advantage can be obtained in that it is possible to determine up to which ensuing section the vehicle can travel with the present balance or whether an increase in the balance is necessary to travel to a targeted exit gate.

Next, a description will be given of an eighth embodiment of the present invention. In this embodiment, a toll for the section or sections which have been traveled up to now is calculated on the road device side, and is notified to the driver by the vehicle-mounted device.

Figure 24:
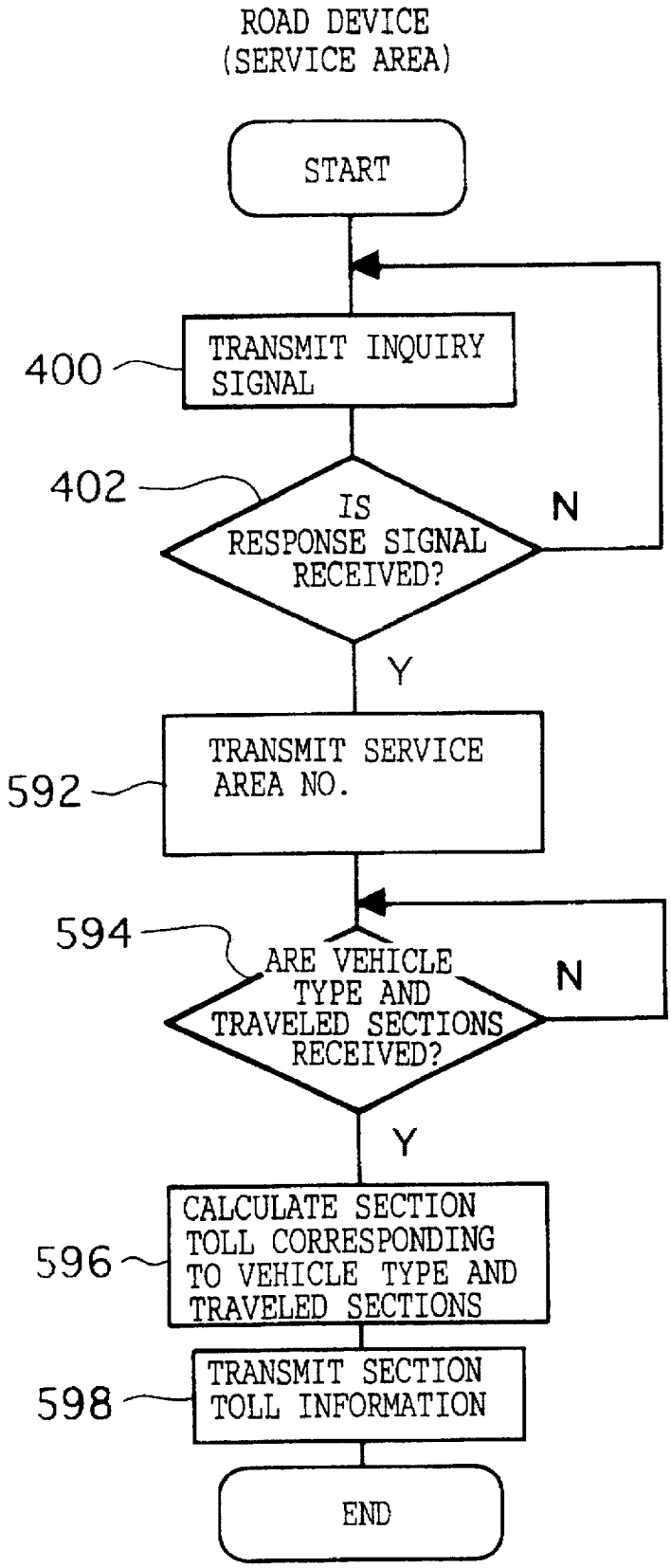
FIG. 24 is a flowchart illustrating a processing routine on the road device side.

As shown in FIG. 24, if it is determined in Step 402 that the road device has received the response signal from the vehicle-mounted device, in Step 592, the road device transmits information on the service area number and the like. Then, in Step 594, a determination is made as to whether the vehicle type information transmitted from the vehicle-mounted device and the traveling history information indicating a traveled section or sections transmitted from the vehicle-mounted device have been received. If these items of information have been received, in Step 596, the section toll is calculated on the basis of the vehicle type information, the traveling history information, and a standard fee for one section. Then, in Step 598, the road device transmits the information on the section toll.

Figure 23:
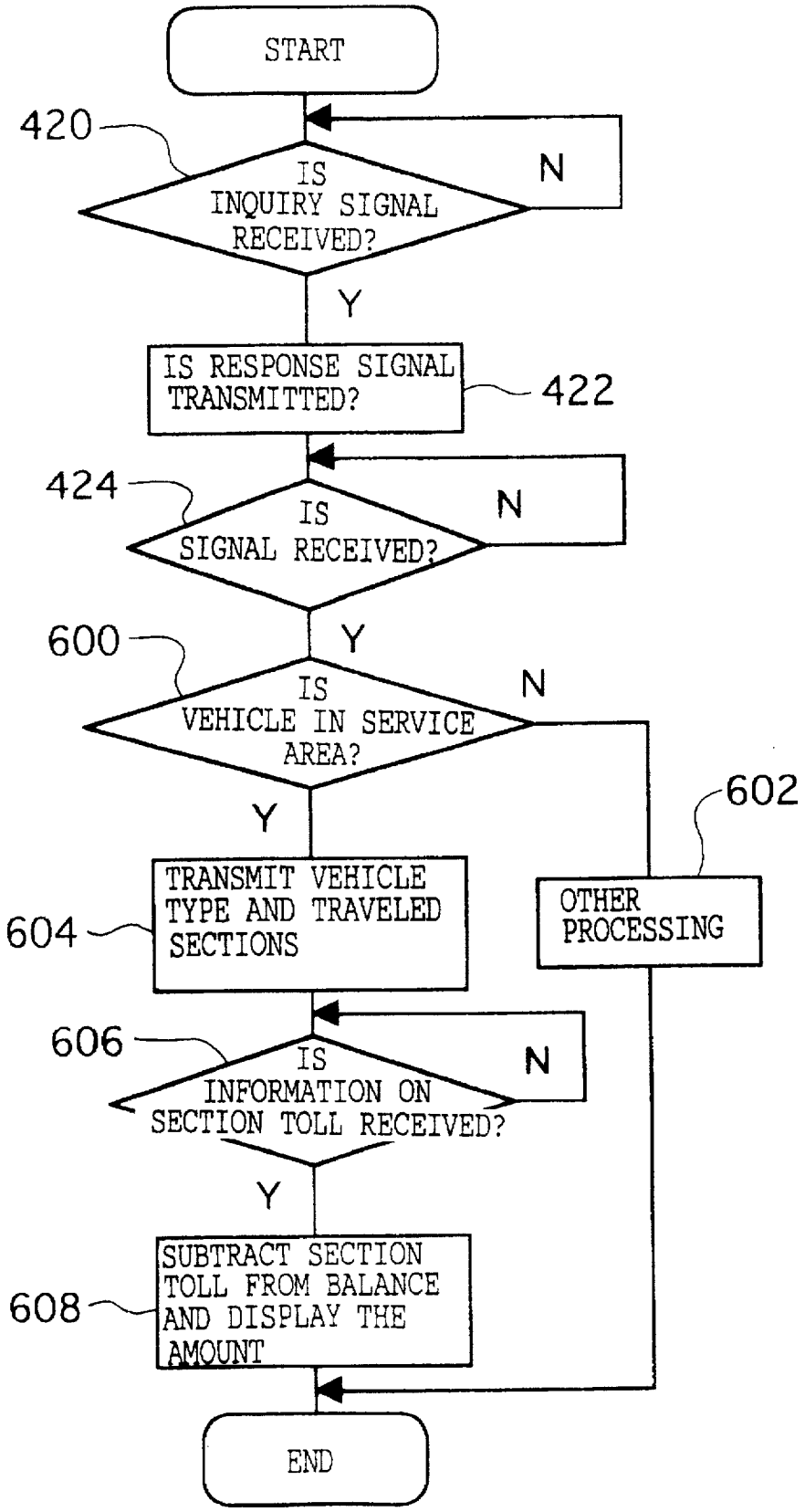
FIG. 23 is a flowchart illustrating a processing routine on the vehicle-mounted device side in a case where a balance corresponding to the traveled section or sections is calculated on the road device side.

FIG. 23 shows a routine for processing by the vehicle-mounted device. If it is determined in Step 424 that the vehicle-mounted device has received the signal from the road device, a determination is made in step 600 as to whether or not the vehicle is located in a service area. If the vehicle is not located in a service area, other processing is carried out in Step 602, and if the vehicle is located in a service area, the vehicle type information and the traveling history information indicating the traveled section or sections are transmitted in Step 604. Then, in Step 606, a determination is made as to whether or not section toll information calculated and transmitted by the road device has been received. If the section toll information has been received, in Step 608, the section toll is subtracted from the balance information by referring to the balance information in the IC card, and the difference is displayed.

In each of the above-described first to eighth embodiments, a description has been given of the example in which an exit gate which is exit information is notified as a reachable range. However, the present invention is not limited to the same, and distance information may be used as the reachable range. In this case, a distance which can be reached with the present balance is notified by being displayed on the display unit or by speech or the like.

Thus, since the distance which can be reached with the present balance is notified, an advantage can be obtained in that it is possible to ascertain the distance at which the balance is to be increased after traveling, i.e., the distance which can be traveled from now.

Next, a description will be given of processing at the exit gate in each of the first to eighth embodiments and embodiments using distance information instead of the exit gate used in the first to eighth embodiments.

Figure 25:
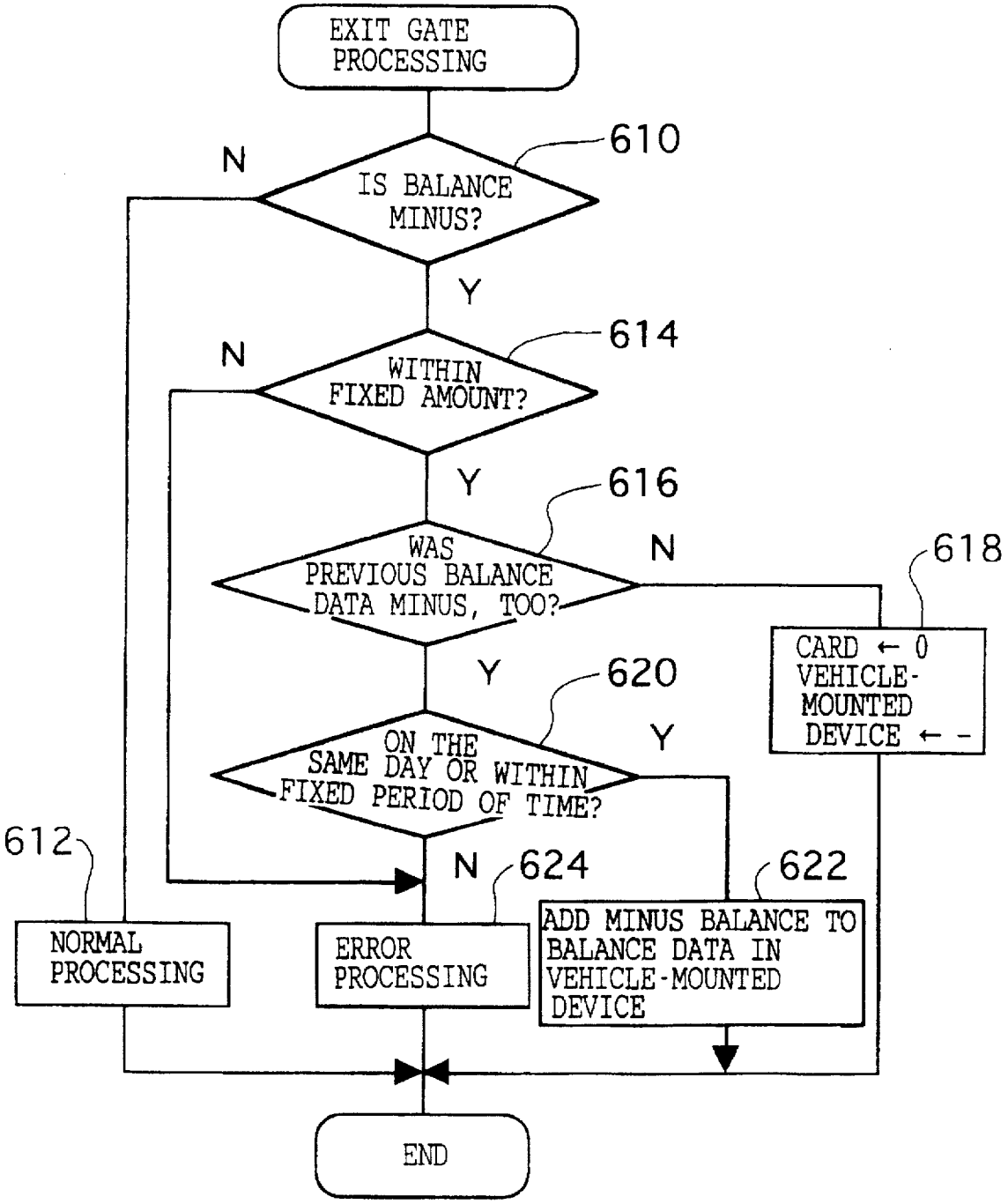
FIG. 25 is a flowchart illustrating a routine for processing at the exit gate.

FIG. 25 shows a routine for processing by the vehicle-mounted device after passing the exit gate. In Step 610, a determination is made as to whether or not the balance information stored in the IC card is minus (in a shortage of the balance). If the balance is plus, in step 612, after the passing vehicle is confirmed by the vehicle type information detected by the vehicle type detector, ordinary automatic toll payment/receipt is carried out, and the balance information after the payment and receipt of the toll is recorded in the IC card.

Meanwhile, if the balance information is minus, a determination is made in Step 614 as to whether the minus amount is within a fixed amount. If it is within the fixed amount, a determination is made in Step 616 as to whether or not the balance data stored in the storage circuit of the vehicle-mounted device is minus, so as to determine whether the balance information was minus previously, too. If the balance information became minus for the first time, in Step 618, the balance in the IC card is set to 0, and the balance data in the storage circuit of the vehicle-mounted device is set as being minus. If the balance information was minus previously, too, a determination is made in Step 620 as to whether or not it became minus on the same day or within a fixed period of time. If YES is the answer in this determination, the minus balance is added to the balance data in the storage circuit of the vehicle-mounted device in Step 622. Meanwhile, if NO is the answer in the determination in Step 620, error processing is carried out in Step 624 for notifying that the vehicle-mounted device or the road device is faulty, for example.

Since error processing is carried out when the balance information has become minus on the same day or within a fixed period of time, it is possible to obtain an advantage in that the failure or the like of the vehicle-mounted device or the road device can be confirmed.

Figure 26:
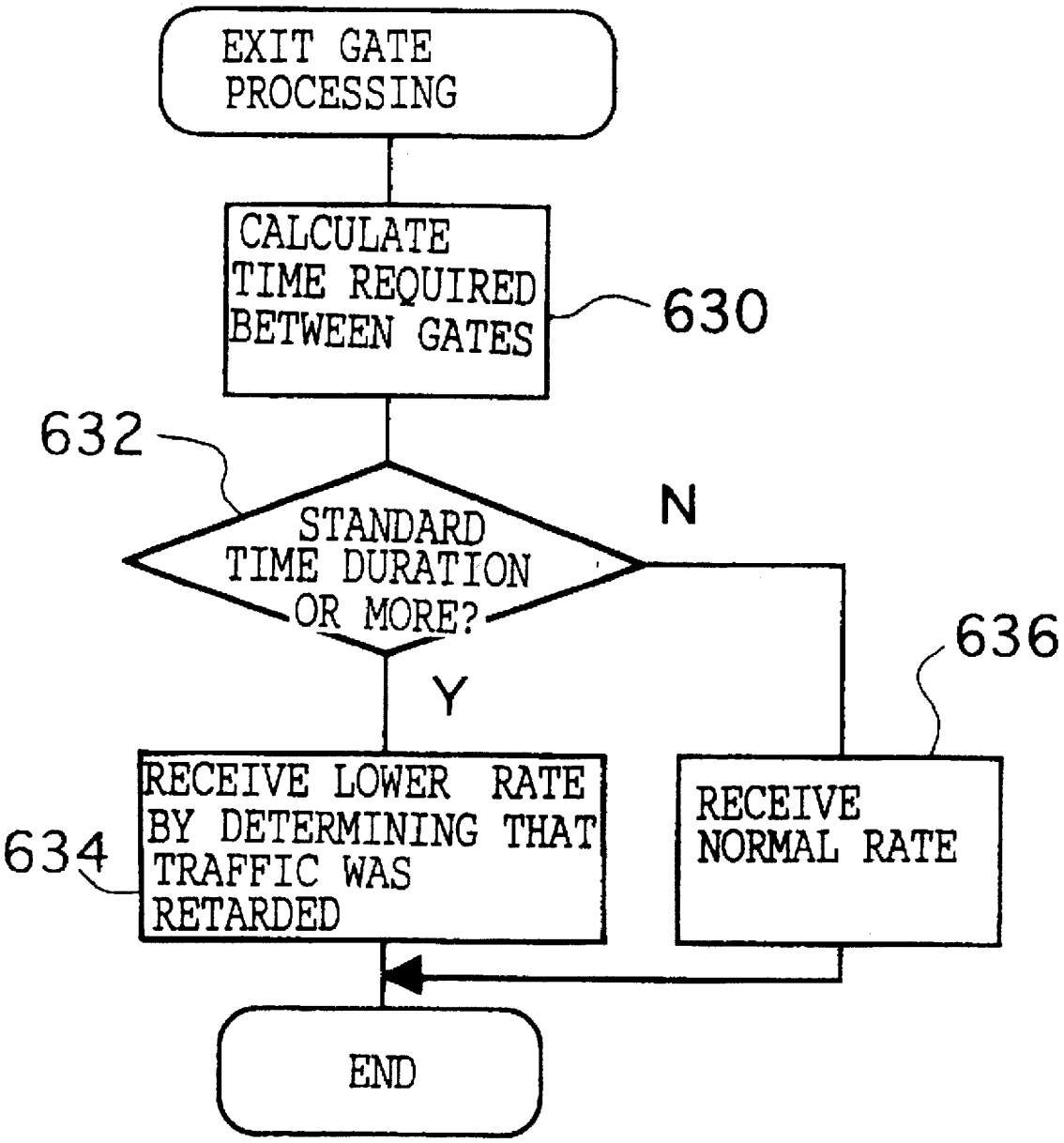
FIG. 26 is a flowchart illustrating a routine for other processing at the exit gate.

FIG. 26 shows another routine for processing at the exit gate, in which the toll is calculated on the basis of the traffic condition, and the calculated result is notified to the driver. First, after the time of passing the entrance gate is stored in advance, in Step 630, the time duration required for reaching the exit gate from the entrance gate is calculated on the basis of the time of passing the entrance gate and the time of passing the exit gate. In Step 632, a determination is made as to whether or not this time duration is a standard time duration or more. If it is less than the standard time duration, a normal rate is paid and received in Step 636. On the other hand, if it is a standard time duration or more, in Step 634, a determination is made that the traffic was congested, and a rate lower than a normal rate is paid and received. Then, the balance after payment of the toll is displayed on the display unit.

Incidentally, an arrangement may be alternatively provided such that, instead of the time duration required for reaching the exit gate from the entrance gate, an average vehicle speed in reaching the exit gate from the entrance gate is determined, a normal rate is paid and received if the average vehicle speed is not less than a predetermined value, while a rate lower than a normal rate is paid and received if the average vehicle speed is less than the predetermined value, and the balance after payment of the toll is displayed on the display unit.

Thus, since the toll is calculated in accordance with the traffic condition, and the calculated result is notified to the driver, it is possible to obtain an advantage in that an accurate balance can be notified in cases where different tolls are charged in accordance with the traffic condition.

Next, a description will be given of processing after the payment and receipt of the toll in each of the first to eighth embodiments and embodiments using distance information instead of the exit gate used in the first to eighth embodiments.

Figure 27:
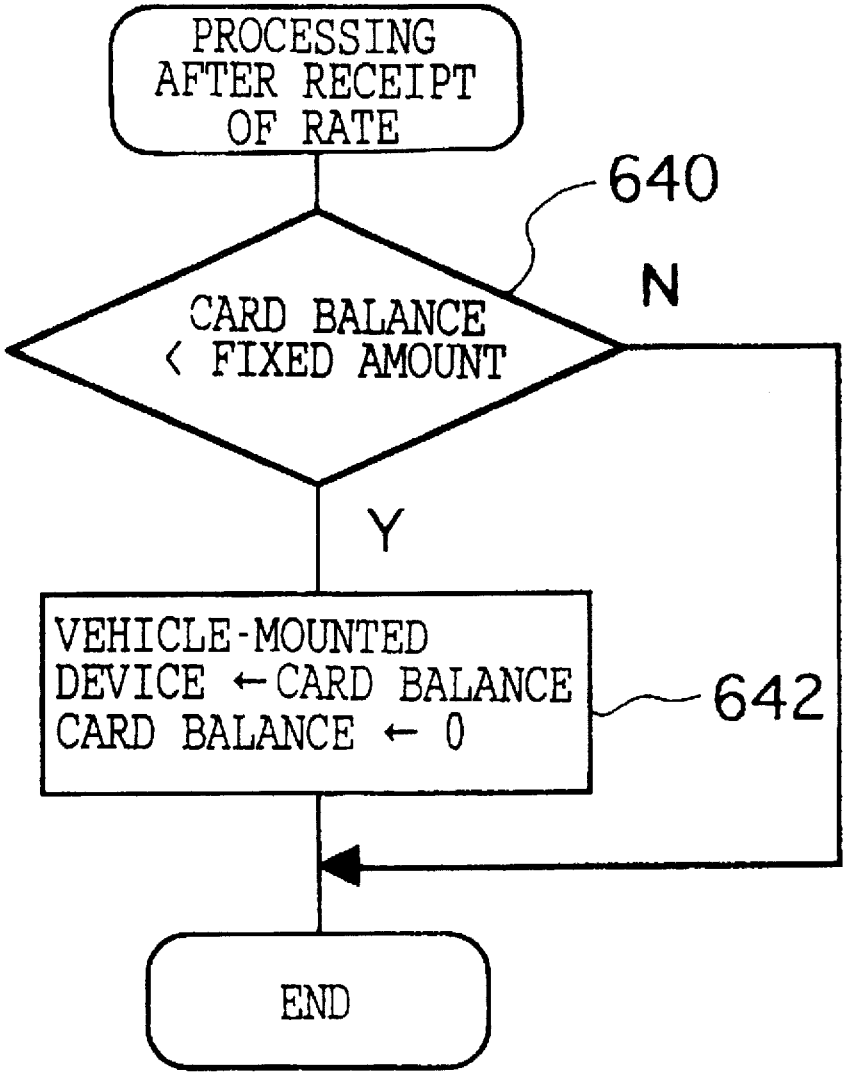
FIG. 27 is a flowchart illustrating a routine for processing after the toll is automatically received.

FIG. 27 shows processing after the payment and receipt of the toll. In Step 640, a determination is made as to whether or not the balance in the IC card is less than a fixed amount (e.g., $10). If the balance is less than the fixed amount, in Step 642, the balance information stored in the IC card is set to 0, and the balance information stored in the card is stored in the storage circuit of the vehicle-mounted device. As a result, it is possible to obtain an advantage in that in cases where a small amount remains in the IC card, the small amount can be made effective use of.

Although, in the above, a description has been given of processing after the receipt of the toll, an arrangement may be provided such that in the case where a small amount remains in the IC card, by loading the IC card in the vehicle-mounted device, and operating the ten key pad or the like of the vehicle-mounted device, the balance information of the IC card is loaded in the storage circuit of the vehicle-mounted device, and the balance information of the IC card is set to 0. In this arrangement as well, it is possible to obtain an advantage in that in cases where a small amount remains in the IC card, the small amount can be made effective use of.

In the above-described embodiments, a description has been given of an example in which a reachable range is notified without taking into consideration the destination of the vehicle. However, an arrangement may be provided such that in a case where destination data has been inputted in a vehicle with a car navigation system mounted therein, a determination is made as to whether or not a toll road is present in the course of travel from the place of departure to the destination, and if a toll road is present, whether the destination can be reached with the present balance is notified each time the vehicle reaches the place of departure and the entrance gate, the branching point, the service area, and the like of the toll road, each time the ignition switch is turned on, or in response to the driver's request for notification, or the like.

Although, in the above, a description has been given by citing a vehicle-mounted device as an example of the apparatus for transmitting information for a vehicle having a notifying device for notifying a reachable range, this apparatus for transmitting information for a vehicle may be installed at an entrance gate or in a service area, so as to notify a user of a reachable range when, for example, the user inserts the card into the apparatus.

IC card 62 is just one example of a portable storage medium that may be used, as will be apparent to those skilled in the art.

What is claimed is:

1. An apparatus for use with a portable storage medium having balance information representing a remaining amount of prepaid toll and for notifying an occupant of a vehicle of a toll based reachable range of the vehicle, comprising:

reading means for reading said portable storage medium to develop a signal representing said balance information;

a calculating means responsive to said signal for calculating the toll based reachable range which can be reached by the vehicle on the basis of a predetermined toll information and said balance information as represented by said signal; and a notifying device for notifying the occupant of the vehicle of the calculated reachable range.

2. An apparatus according to claim 1, wherein the reachable range corresponds to at least one of exit information and distance information.

3. An apparatus according to claim 1, wherein, in a case in which a branching point is present in a course of travel, the reachable range corresponds to at least one of exit information and distance information, each information corresponding to each route branching from said branching point.

4. An apparatus according to claim 3, further comprising:

selecting means for selecting at least one of the exit information and the distance information, each information corresponding to said each route.

5. An apparatus according to claim 3, further comprising:

notification stopping means for stopping the notification of the exit information and the distance information concerning a route other than the route being traveled when the vehicle has passed the branching point.

6. An apparatus according to claim 4, further comprising:

notification stopping means for stopping the notification of the exit information and the distance information concerning a route other than the route being traveled when the vehicle has passed the branching point.

7. An apparatus according to claim 1, further comprising:

detecting means for detecting the entry of the vehicle into an area where a toll prepaying device for prepaying the toll to increase the remaining prepaid toll is installed, the occupant of the vehicle being notified by said notifying device of the entry of the vehicle into the area where said toll prepaying device is installed.

8. An apparatus according to claim 1, wherein the calculation of the reachable range is not performed while the vehicle is stopped.

9. An apparatus according to claim 7, wherein a time when the toll is prepaid is calculated on the basis of positional information indicating a position of said toll prepaying device, and said notifying device notifies said time to the occupant of the vehicle.

10. A system for communicating information for a vehicle, which enables paying a toll through communication between a road device which is installed on a road and a vehicle-mounted device which is mounted in the vehicle and in which a card with balance information recorded therein can be loaded, said system comprising:

collating means disposed in said vehicle-mounted device for receiving and assembling the balance information recorded on the card;

calculating means disposed in one of said road device and said vehicle-mounted device for calculating the reachable range which can be reached by the vehicle with a present balance, on the basis of the balance information assembled by said collating means and predetermined toll information; and notifying means disposed in said vehicle-mounted device for notifying an occupant of the vehicle of the calculated reachable range.

11. A system according to claim 10, wherein the reachable range corresponds to at least one of exit information and distance information.

12. A system according to claim 10, wherein, in a case in which a branching point is present in a course of travel, the reachable range to be notified corresponds to at least one of exit information and distance information, each information corresponding to each route branching from said branching point.

13. A system according to claim 12, further comprising:

selecting means for selecting at least one of the exit information and the distance information, each information corresponding to said each route.

14. A system according to claim 12, further comprising:

notification stopping means for stopping the notification of the exit information and the distance information concerning a route other than the route being traveled when the vehicle has passed the branching point.

15. A system according to claim 13, further comprising:

notification stopping means for stopping the notification of the exit information and the distance information concerning a route other than the route being traveled when the vehicle has passed the branching point.

16. A system according to claim 10, further comprising:

detecting means for detecting the entry of the vehicle in to an area where a toll prepaying device for prepaying the toll to increase the remaining prepaid toll is installed, the occupant of the vehicle being notified by said notifying device of the entry of the vehicle into the area where said toll prepaying device is installed.

17. A system according to claim 10, wherein the calculation of the reachable range is not performed while the vehicle is stopped.

18. A system according to claim 16, wherein a time when the toll is prepaid is calculated on the basis of positional information indicating a position of said toll prepaying device, and said notifying device notifies said time to the occupant of the vehicle.

19. A system for communicating information for a vehicle, comprising:

traveled-condition detecting means for detecting traveled conditions determined by an average vehicle speed in the travel; and notifying means for notifying an occupant of the vehicle of a toll calculated on the basis of results of detection by said traveled-condition detecting means.

20. A system according to claim 19, wherein said system is an automatic toll paying system for paying a toll through communication between a road device which is installed on a road, and a vehicle-mounted device which is mounted in the vehicle and in which a card with balance information recorded therein can be loaded.

21. A system according to claim 20, wherein a calculating means is disposed in said vehicle-mounted device for calculating the toll on the basis of the results of detection by said traveled-condition detecting means.

* * * * *